US008863850B2

(12) United States Patent
Sherman et al.

(10) Patent No.: US 8,863,850 B2
(45) Date of Patent: Oct. 21, 2014

(54) APPARATUS AND METHOD FOR STIMULATING SUBTERRANEAN FORMATIONS

(75) Inventors: Scott Sherman, Calgary (CA); Robert Pugh, Okotoks (CA); Sean Majko, Calgary (CA); Steve Scherschel, Calgary (CA)

(73) Assignee: Trican Well Service Ltd, Calgary (CA)

( * ) Notice: Subject to any disclaimer, the term of this patent is extended or adjusted under 35 U.S.C. 154(b) by 0 days.

(21) Appl. No.: 12/999,940

(22) PCT Filed: Jun. 22, 2010

(86) PCT No.: PCT/CA2010/000955

§ 371 (c)(1),
(2), (4) Date: Apr. 8, 2011

(87) PCT Pub. No.: WO2010/148494

PCT Pub. Date: Dec. 29, 2010

(65) Prior Publication Data

US 2012/0111566 A1 May 10, 2012

(30) Foreign Application Priority Data

Jun. 22, 2009 (CA) ..... 2670218
Oct. 23, 2009 (CA) ..... 2683432
Feb. 8, 2010 (CA) ..... 2692377

(51) Int. Cl.
*E21B 34/10* (2006.01)
*E21B 29/00* (2006.01)
*E21B 43/25* (2006.01)
*F16K 17/40* (2006.01)
*E21B 34/06* (2006.01)

(52) U.S. Cl.
CPC ..... *E21B 34/063* (2013.01); *E21B 43/25* (2013.01)
USPC ..... 166/376; 166/305.1; 166/308.1; 166/317; 166/387; 137/68.19; 137/382; 138/92

(58) Field of Classification Search
USPC ..... 166/250.04, 271, 289, 290, 297, 298, 166/305.1, 307, 308.1, 373, 374, 376, 381, 166/387, 55, 55.1, 100, 177.5, 223, 317; 137/68.19, 377, 382; 138/92; 220/89.2
See application file for complete search history.

(56) References Cited

U.S. PATENT DOCUMENTS 2,191,750 A * 2/1940 Brown ..... 166/63
2,775,304 A * 12/1956 Solis ..... 166/100
2,855,049 A * 10/1958 Solis ..... 166/100
3,057,405 A * 10/1962 Mallinger ..... 166/288
3,120,268 A * 2/1964 Caldwell ..... 166/100
3,245,472 A * 4/1966 Solis ..... 166/100
3,273,641 A * 9/1966 Bourne ..... 166/276
3,326,291 A * 6/1967 Solis ..... 166/100
4,673,039 A * 6/1987 Mohaupt ..... 166/281

(Continued)

OTHER PUBLICATIONS

Schlumberger Oilfield Glossary entry for "collar", accessed Jun. 13, 2013 via www.glossary.oilfield.slb.com.*

(Continued)

*Primary Examiner* — Blake Michener
(74) *Attorney, Agent, or Firm* — Sean W Goodwin

(57) ABSTRACT

A method of stimulating a subterranean formation using a tubular member with one or more burst disks therein.

41 Claims, 23 Drawing Sheets

(56) References Cited

U.S. PATENT DOCUMENTS

| | | | | |
|---|---|---|---|---|
| 5,103,911 | A | 4/1992 | Heijnen | |
| 5,425,424 | A | 6/1995 | Reinhardt | |
| 5,511,617 | A * | 4/1996 | Snider et al. | 166/291 |
| 6,446,727 | B1 | 9/2002 | Zemlak | |
| 6,675,898 | B2 * | 1/2004 | Staudt | 166/363 |
| 7,096,954 | B2 * | 8/2006 | Weng et al. | 166/308.1 |
| 7,267,172 | B2 * | 9/2007 | Hofman | 166/281 |
| 8,104,538 | B2 * | 1/2012 | Richard et al. | 166/308.1 |
| 2003/0121663 | A1 | 7/2003 | Weng | |
| 2006/0196539 | A1 * | 9/2006 | Raska et al. | 137/68.24 |
| 2006/0243435 | A1 * | 11/2006 | Faul | 166/241.1 |
| 2007/0272411 | A1 * | 11/2007 | De Cardenas et al. | 166/305.1 |
| 2009/0044944 | A1 * | 2/2009 | Murray et al. | 166/308.1 |
| 2011/0146994 | A1 * | 6/2011 | Lewis et al. | 166/308.1 |
| 2011/0155377 | A1 * | 6/2011 | Laun | 166/308.1 |
| 2011/0186297 | A1 * | 8/2011 | Zhang et al. | 166/308.1 |
| 2011/0315380 | A1 * | 12/2011 | Sherman | 166/285 |
| 2012/0037366 | A1 * | 2/2012 | Sherman | 166/297 |

OTHER PUBLICATIONS

ISA/CA. Written Opinion of the International Searching Authority. Oct. 18, 2010.

* cited by examiner

DETAIL A

DETAIL B

DETAIL A

SECTION A-A

DETAIL A

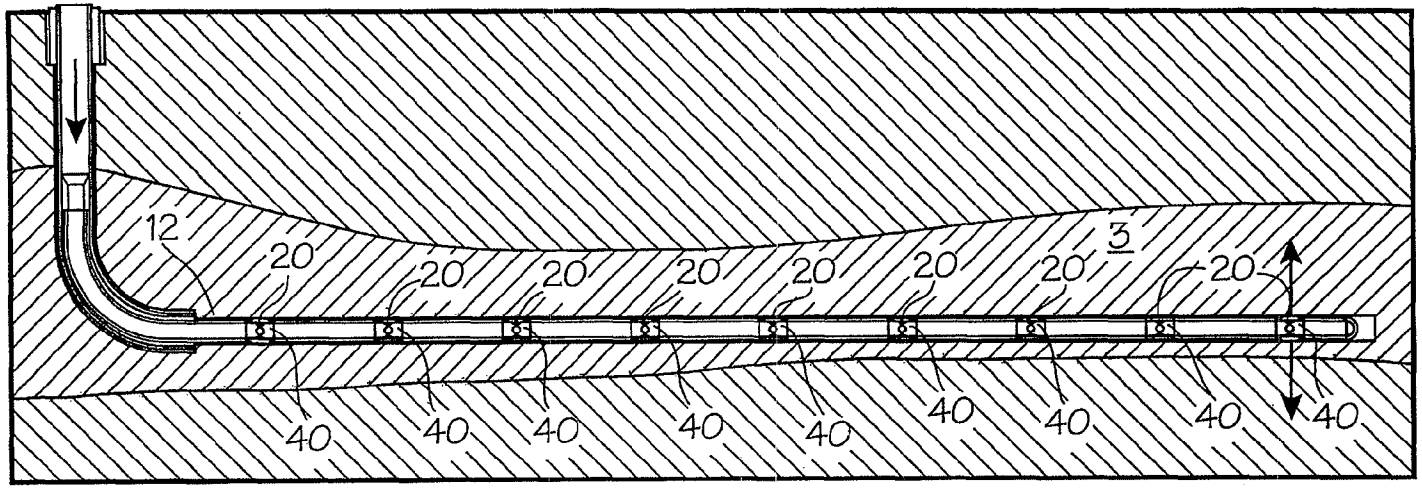
12
20
20
20

VIEW B-B

APPARATUS AND METHOD FOR STIMULATING SUBTERRANEAN FORMATIONS

FIELD

This invention relates to stimulation of subterranean formations.

BACKGROUND

In the recovery of oil and gas from subterranean formations it is common practice to fracture the hydrocarbon-bearing formation, providing flow channels for oil and gas. These flow channels facilitate movement of the hydrocarbons to the wellbore so they may be produced from the well. Without fracturing, many wells would not be economically viable.

In such fracturing operations, a fracturing fluid is hydraulically injected down a wellbore penetrating the subterranean formation. The fluid is forced down the interior of the wellbore casing, through perforations, and into the formation strata by pressure. The formation strata or rock is forced to crack open, and a proppant carried by the fluid into the crack is then deposited by movement of the viscous fluid containing proppant into the crack in the rock. The resulting fracture, with proppant in place to hold open the crack, provides improved flow of the recoverable fluid, i.e., oil, gas, or water, into the wellbore.

The perforations are generally produced by lowering a tool containing explosive charges into the wellbore to the depth of the formation of interest and detonating the explosive charges. In many cases, the wellbore casing or completion string is cemented to the subterranean formations, and the explosive charges penetrate the cement and casing.

These charges are shaped to provide outward forces and to blast a hole through the wellbore casing and into the hydrocarbon bearing formation.

Due to the hazards of handling, transporting, and using explosives in the remote locations where oil and gas wells are frequently located, it is desirable to eliminate the use of explosives as a means to create wellbore casing perforations.

Prior art fracturing systems often use expensive equipment to produce the perforations, and to control which of the perforations the fracturing fluid will flow and which area of the formation will be subject to stimulation. Once fracturing is complete, the equipment must remain in the wellbore, which is very expensive.

SUMMARY

In one aspect, this invention discloses a method of stimulating a subterranean formation having a wellbore formed therein which includes a completion string having a wall with burst disks formed therein, and a well treatment tool connected to and in fluid communication with a treatment tubing having a conduit therein. The tool has at least one opening formed straddled by two interval isolation devices. The treatment tubing is fed into the completion string and the well treatment tool is positioned such that the isolation devices straddle the set of burst disks. Treatment fluid is then pumped under pressure through the conduit, and treatment fluid ejecting from the opening in the tool increases pressure within a space within the completion string between the two interval isolation devices to rupture the burst disks. Subsequent to the rupture of burst disks, the treatment fluid passes into an isolated annulus interval and then stimulates the formation.

In another aspect, this invention discloses a method of stimulating a subterranean formation having a wellbore formed therein comprising the step of rupturing burst disks in any sequence, wherein the sequence is independent of the pressure threshold of the burst disks.

In yet another aspect, this invention discloses a burst disk in a completion string wall defined by a discrete section of the string wall with reduced thickness. This section of reduced wall thickness is defined by an end wall of a bore formed partway through the completion string wall.

In yet another aspect, this invention discloses a method of stimulating a subterranean formation having a wellbore formed therein comprising the step of rupturing a set of burst disks using a well treatment tool, moving the tool downhole from the set of burst disks, pumping treatment fluid down the annulus between the treatment tubing and completion string through the ruptured burst disks to stimulate the formation.

In another aspect, this invention relates to a method comprising providing a tubular member capable of fluid flow in a wellbore of a subterranean formation, wherein the tubular member comprises at least one burst disk with a rupture pressure threshold and positioned at a location within the tubular element, wherein the burst disk blocks the flow of fluid while intact, and is adapted to rupture at the rupture pressure threshold to provide a flow path for fluid inside the tubular member to the outside of the tubular member; isolating the burst disk; flowing fluid in the tubular member; and, increasing the pressure inside the tubular member until the burst disk ruptures.

A plurality of burst disks can be included in the tubular member wherein each burst disk has a rupture pressure threshold and is positioned at a location within the tubular member, and wherein each burst disk blocks the flow of fluid while intact, and is adapted to rupture at the rupture pressure threshold to provide a flow path for fluid inside the tubular member to the outside of the tubular member. After after rupturing a first burst disk, a second burst disk may be isolated, fluid may be flowed in the tubular member; and the pressure may be increased inside the tubular member until the second burst disk ruptures. The steps of isolating a burst disk, flowing fluid in the tubular member; and, increasing the pressure inside the tubular member until the isolated burst disk ruptures, can be repeated for additional burst disks in the tubular member. The order of isolating of the burst disks may independent of the rupture pressure thresholds of the burst disks. In the case of a horizontal well, the order of rupture may be from the toe end to a heal section or in the reverse direction. In a vertical well, the order can be top to bottom or bottom to top.

An inside section of the tubular member where the burst disk is located, may be sealed with at least one isolation device whereby the increase in pressure is confined to the isolated section of the tubular member defined by the isolation device.

The isolation device can be selected from the group consisting of at least one packer and at least one cup or may be located on a treatment string in the tubular member. The isolation device may comprise a cup-cup tool.

The burst disk may comprises a cap which blocks fluid flow to the burst disk from outside of the tubular member.

Fluid can be flowed in the tubular member at a pressure sufficient to stimulate the formation.

A section of annulus formed by the tubular member and the wellbore where the burst disk is located may be sealed with at least one isolation device.

A section of annulus formed by the tubular member and the wellbore where the burst disk is located may be cemented.

The annulus at the burst disk location may be sufficiently minimized whereby the cement can be ruptured by a fluid flowing through the ruptured burst disk. A section of the subterranean formation may be treated by flowing a treatment fluid through the ruptured burst disk wherein the cement is sufficiently ruptured to permit the treatment fluid to reach the formation.

In a further aspect, this invention relates to a burst disk comprising a port in a wall of the tubular member, a burstable disk with a rupture pressure threshold sealing the port when intact, and a cap spaced from the burstable disk, wherein the cap and burstable disk defining a chamber in the port. The atmospheric pressure inside the chamber may be sufficiently low to facilitate rupture of the burstable disk. The burstable disk may be integrally formed with the wall of the tubular member. The burstable disk may be sealingly engaged with the port. The burst disk may further comprise a retainer for maintaining the burstable disk in sealing engagement with the port when intact.

In yet another aspect, this invention relates to a method further comprising (a) providing a tubular member capable of fluid flow in a wellbore of a subterranean formation, wherein the tubular member comprises a plurality of burst disks, each burst disk with a rupture pressure threshold and positioned at a location within the wall of the tubular element, (b) isolating a first burst disk by a movable isolation device, (c) bursting the first disk, (d) moving the isolation device down hole of the first burst disk, (e) prior to isolating a second burst disk, treating a section of the subterranean formation by flowing a fluid through the ruptured first burst disk, (f) moving the isolation device up hole of the first burst disk, (g) isolating the second burst disk by the movable isolation device (h) bursting the second disk, (i) moving the isolation device down hole of the second burst disk, and sealing the ruptured first burst disk, and (j) treating a section of the subterranean formation by flowing a fluid through the ruptured second burst disk. The isolation device may be selected from the group consisting of at least one packer and at least one cup, a cup-cup tool, and a tool with two packers or two cups. Steps (d) to (j) may be repeated for each remaining intact burst disk, and it will be understood that in repeating steps (d) to (j), the "first burst disk" and "second burst" become the third and fourth burst disks respectively. Steps (d) to (j) may be repeated for subsequent burst disks (fourth/fifth, sixth/seventh etc.).

In another aspect, this invention relates to a method comprising providing a tubular member capable of fluid flow in a wellbore of a subterranean formation, wherein the tubular member comprises at least one acid soluble burst disk with an acid concentration threshold and positioned at a location within the tubular element, wherein the burst disk blocks the flow of well treatment while intact, and is adapted to dissolve at the acid concentration threshold to provide a flow path for fluid inside the tubular member to the outside of the tubular member. The annulus formed by the tubular member and the wall of the wellbore may be sealed with a cement which may be acid soluble. An acid may be flowed in the tubular member at a concentration sufficient to at least partially dissolve at least one burst disk to permit a fluid to flow through the burst disk and may be flowed through the dissolved burst disk to at least partially dissolve the cement to permit a fluid to flow through the cement to the formation wall. A fluid may be in the tubular member at a pressure sufficient to stimulate the formation. A section of the annulus formed by the tubular member and the wellbore where the burst disk is located may be sealed with at least one isolation device. The isolation device may be movable and may be selected from the group consisting of a packer and a cup, two packers, two cups and a cup-cup tool.

A first acid soluble burst disk may be isolated by a movable isolation device, an acid may be flowed at a concentration sufficient to at least partially dissolve the first burst disk to rupture it to permit a fluid to flow through the burst disk, the isolation device may be moved down hole of the first burst disk following rupture, a section of the subterranean formation may be treated by flowing a fluid through the ruptured burst disk, and the ruptured first burst disk can be sealed. After sealing the ruptured burst disk, the isolation device may be moved to a second acid soluble burst disk to isolate it, an acid may be flowed at a concentration sufficient to at least partially dissolve at the second burst disk to rupture it to permit a fluid to flow through the burst disk, the isolation device may be moved down hole of the second burst disk following rupture, and a section of the subterranean formation may be treated by flowing a fluid through the ruptured second burst disk.

In another aspect, this invention relates to a method comprising providing a first tubular member capable of fluid flow in a wellbore of a subterranean formation, wherein the tubular member comprises at least one burst disk with a rupture pressure threshold and positioned at a location within the tubular member, wherein the burst disk blocks the flow of well treatment while intact, and is adapted to rupture at the rupture pressure threshold to provide a flow path for fluid inside the tubular member to the outside of the tubular member; providing a second tubular member in the first tubular member; isolating the burst disk; flowing fluid in the second tubular member; and, increasing the pressure inside the first tubular member until the burst disk ruptures. The burst disk may be isolated by at least one isolation element exterior to the first tubular member and at least one isolation element in the annulus between the first and second tubular members. The exterior isolation element may be cement. A fluid may be flowed in the second tubular member and inside the first tubular member until the isolated burst disk ruptures. At least one other burst disk at a different interval may be present in the tubular member and the steps of isolating, flowing fluid and rupturing can be repeated for the other burst disk or disks. A fluid may be flowed in the first tubular member at a pressure sufficient to stimulate the formation. The ruptured burst disk may be sealed with particulate, a ball or other suitable sealing means.

In another aspect, this invention relates to a burst disk assembly comprising a port, a burstable disk with a rupture pressure threshold sealingly engaged with the port wherein the burstable disk blocks the passage of fluid through the port while intact; and a cap sealingly engaged with the port and spaced from the burstable disk wherein the cap blocks the passage of fluid through the port while intact and wherein the port, burstable disk and cap define a chamber. The chamber may contain a fluid while the burstable disk is intact at a pressure which facilitates rupture of the burstable disk. The burst disk can further comprise a retainer for retaining the burstable disk in sealing engagement with the port.

In a still further aspect, this invention relates to a bottom hole tool comprising a tubular member comprising a conduit capable of fluid flow and adapted to be connected to a treatment string, a flow activation equalization valve in the conduit for controlling fluid flow in the conduit, and, at least one isolation element exterior to the tubular member. The valve may be adapted to be actuated by fluid flow in the treatment string. A piston may be connected to the valve. The piston may be spring biased whereby fluid pressure acting on the piston causes the piston to act on the valve to at least partially close it, and an absence of pressure acting on the piston causes the piston to be biased such that the valve is at least partially opened. The valve may further comprise sealing portions comprised of a ceramic, a silicon nitride and a boron carbide.

In yet a further aspect, this invention relates to a method comprising providing a tubular member capable of fluid flow in a wellbore of a subterranean formation, wherein the tubular member comprises at least one burst disk with a rupture pressure threshold and positioned at a location within the tubular element, wherein the burst disk blocks the flow of well treatment while intact, and is adapted to rupture at the rupture pressure threshold to provide a flow path for fluid inside the tubular member to the outside of the tubular member; cementing the tubular member in place at least at the location of the at least one burst disk, flowing a fluid in the tubular member; and, increasing the pressure inside the tubular member until all of the at least one burst disk in the tubular member rupture. The cement may be sufficiently ruptured to permit fluid access to the formation from at the ruptured at least one burst disk and fluid may be flowed through the ruptured burst disk to for example treat (such as by fracturing) the formation. A bottom hole assembly ("BHA") may be provided in the tubular member and the flowing fluid may be used to move the assembly. The BHA may be connected to a wireline. The BHA may be a perforation gun or other tool. The BHA may further comprise a swab cup.

In another aspect, this invention relates to a method comprising: providing a tubular member capable of fluid flow in a wellbore of a subterranean formation whereby the tubular member and the wall of the subterranean formation define an annulus, providing a cement into at least a section of the annulus to secure the tubular member in the wellbore, providing a milling tool in the tubular member, milling at least one port in the tubular member with the milling tool, flowing a fluid through the port to fracture the formation. At least a section of the cement may be ruptured to permit fluid access from the tubular member to the wall of the formation. The milling tool up hole may be moved up hole following the fracture of the formation.

In another aspect, this invention relates to a method comprising: providing a tubular member capable of fluid flow in a wellbore of a subterranean formation wherein the tubular member comprises at least one port positioned at a location within the tubular element, and an aperture (such as a sliding sleeve) for opening and closing the at least one port, and wherein the tubular member and the wall of the subterranean formation define an annulus, introducing cement into at least a section of the annulus to secure the tubular member in the wellbore, opening the aperature at the at least one port, and flowing a fluid through the opened at least one port. The cement may be ruptured by the flow of the fluid through the port and the fluid may be used to fracture the formation.

BRIEF DESCRIPTION OF THE DRAWINGS

FIG. 8B is a drawing of a cross-section of a wellbore and a completion string of FIG. 8A with fluid pumping down the completion string and burst disks at a first zone ruptured.

FIG. 8C is a drawing of a cross-section of a wellbore and a completion string of FIG. 8A with a sealing device uphole from the first zone.

DETAILED DESCRIPTION OF THE PREFERRED EMBODIMENTS

Figure 1A:
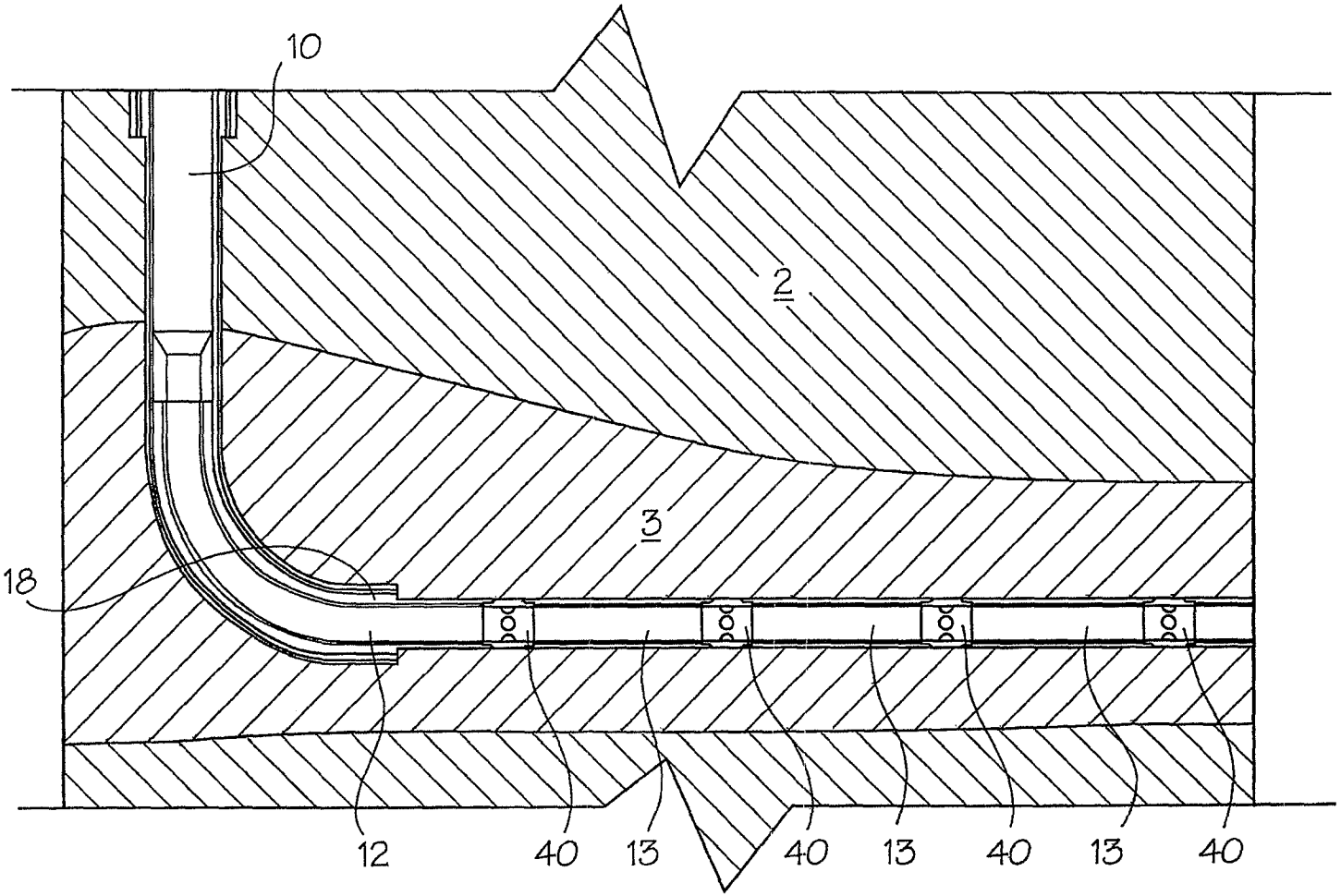
FIG. 1A is a drawing of a cross-section of a wellbore and a completion string having burst disks in accordance with one embodiment of this invention.
Figure 1B:
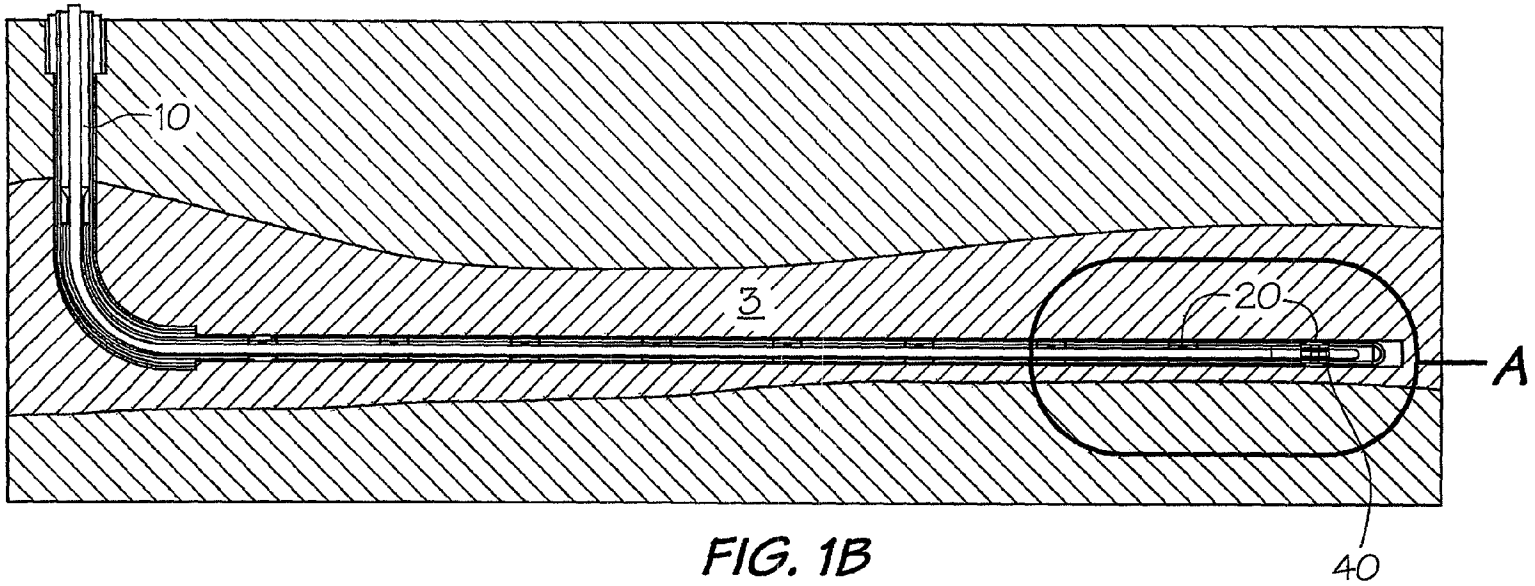
FIG. 1B is a drawing of the cross-section of the wellbore and completion string of FIG. 1A with a treatment tubing and tool inserted therein positioned at a first zone.

In general, apparatus and methods of this invention can be applied to a horizontal, deviated or vertical open hole completion or cemented condition, or a frac through coil system where a multi-stage cased/open hole, hybrid system is used where isolation and frac points are set up along an open hole section of a well to give full bore access to the wellbore casing string at the completion of the stimulation.

Referring to FIGS. 1A to 1F, in a sequence of steps in stimulating a formation according to one embodiment of this invention, a section of a wellbore 10 is drilled through the earth 2 having a subterranean hydrocarbon bearing formation 3. The wellbore 10 is a horizontal well. Within the wellbore 10 is a completion string 12.

A completion string is usually a tubular pipe also commonly known as production casing or well bore liner that is usually permanently installed in the well bore. A completion string may be a wellbore casing, liner, tubulars or any other similar tubing.

The completion string 12 is in what is commonly known as open hole condition, meaning that the annular space 18 between completion string 12 and the wellbore 10 is not purposely filled.

Segments of a completion string can be joined together with collars. The completion string 12 includes collars 40 that join sections 13 of the completion string 12 together. The collars 40 are equally spaced but need not be equally spaced along the completion string 12 and are usually placed at intervals determined by the conditions of the hydrocarbon bearing formation and the results desired from the stimulation process.

The collars 40 of the completion string 12 include burst disks which are housed in burst ports 20 of the collars 40. In general, a burst disk is a device which is designed to rupture once a certain pressure threshold is reached thus opening a port in the wall in which it is located.

Burst disks embodying the principles of the invention can be located within different types of bodies. For example, the body can be a completion string or like tubing or piping, or a collar. A "collar" is a tubular section of larger outside diameter and shorter length than the adjacent tubular sections that comprise the majority of a drill string. Often collars are used to join tubular sections together, and as such may have any combination of thread types on their ends. Collars may also serve functions other than simply extending the drill string or joining sections of tubulars together. Burst disks can also be located in the walls of a completion string. Bodies, including completion strings, drill strings, and treatment strings, tubulars, tubing, piping and collars are also referred to herein as tubular members.

A treatment string is usually a tubular pipe for conveying fluids, such as but not limited to coiled tubing and collars, for conveying fluids, that is not permanently installed in a well bore. Treatment tubing is commonly inserted into a wellbore (in either an open hole or completed state) to convey fluid into and/or out of the wellbore to for example, stimulate a subterranean formation. It is also known to attach a bottom hole ("BHA") device to treatment tubing where the treatment tubing can be used to insert and/or remove the BHA and convey fluid to operate the BHA.

Figure 12A:
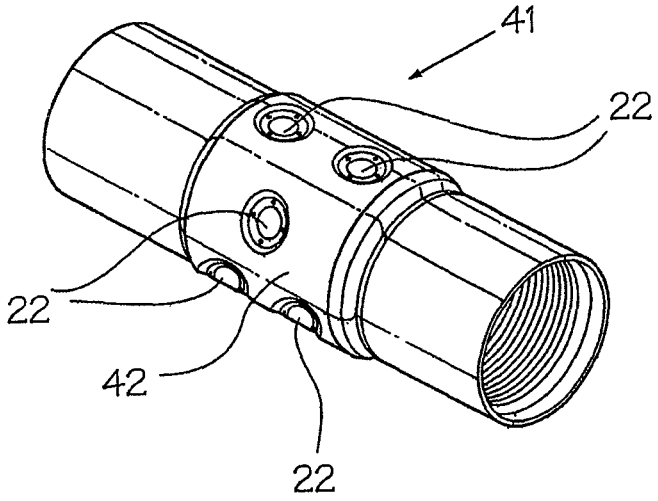
FIG. 12A is a collar according to one embodiment of this invention.

One embodiment of a collar suitable for the invention in which burst disks can be placed is shown in FIG. 12A. The collar indicated generally at 41 includes a central section 42. Burst disk assemblies 22 are housed in ports 20 in the central section 42 of the collar 41.

Figure 12B:
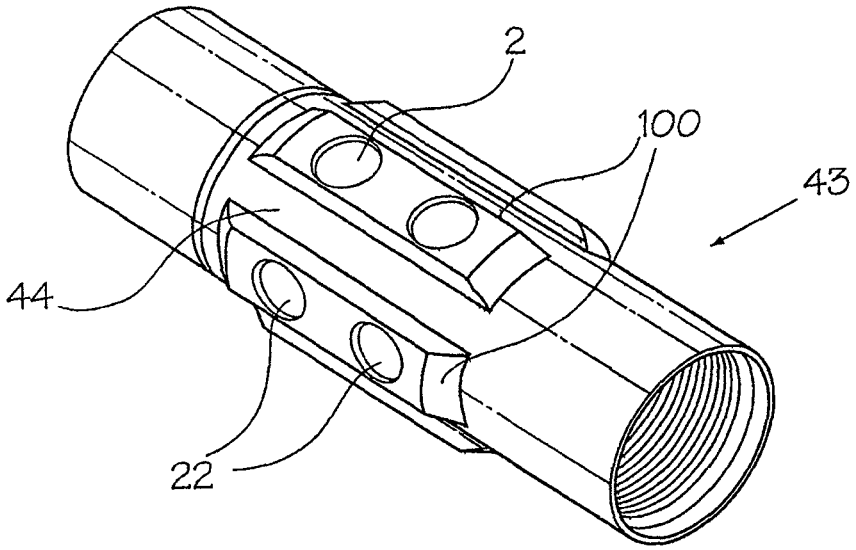
FIG. 12B is a collar according to another embodiment of this invention.

Another embodiment of a collar suitable for the invention in which burst disk assemblies 22 can be placed is shown in FIG. 12B. The collar indicated generally at 43 is a collar with a central section 44. Fins 100 protrude outwardly from the wall of the collar 43 thereby decreasing the space between collar 43 and a wellbore when installed.

Referring principally to FIGS. 10A, 12A, 12B, and 10A to 10D, the burst disk assembly 22 comprises a retainer 140, which in turn threads into the wall 400. If the burst disk assembly 22 is housed in a collar of the type of the collar 41, the wall 400 forms part of the central section 42. Alternatively, if the burst disk assembly 22 is housed in a collar of the type of collar 43, the wall 400 forms part of one of the fins 100. The retainer 140 is threaded into the wall 400 by threads 153 to hold the burstable disk 148 in place. O rings 155 are provided between the wall 400 and the retainer 140 and the burstable disk 148. A cap 150 fits into retainer 140 such that a pressure tight seal is formed between the central conduit of a completion string and the outside of the completion string whether it is inside a wellbore or outside. The cap 150 is covered with a protective mastic 152, such as silicone sealant to protect it during shipping and handling, and to help retain it in place. The chamber 157 formed between the burst disk and the cap 150 normally contains air, but may be filled with other fluids, depending upon the operational circumstances.

The cap 150 prevents pressure on the outside of a completion string or collar from bursting the burstable disk 148 from the outside of the string or collar inward during the placement, servicing, or cementing of the collar or completion string in which it is housed. The chamber 157 is normally close to atmospheric pressure until the burstable disk 148 bursts. The atmospheric pressure facilitates the bursting of the burstable disk 148 at a predictable pressure, as the necessary pressure acting inside the collar and against the interior side of the disk can be determined in a reliable manner. The burstable disk 148 in a burst condition is depicted in FIGS. 10B to 10E.

Referring principally to FIGS. 2A to 4B, in an alternate embodiment, a burst disk assembly embodying the principles of the present invention may be formed by machining the sidewall of a collar or any portion of a wall of a completion string to produce a thin section which serves as a burstable disk. Alternatively, the burstable disk may be a thin sheet of material with properties such that it will rupture at the desired pressure differential across it.

The burstable disk 20*a* is made from the same material as the wall 401 of the completion string or collar in which it is formed.

The burstable disk 20*a* can be circular in shape. In one embodiment, the burstable disk 20*a* has a diameter between ¼ inch and 1 inch when used with a completion string of suitable material and thickness. More preferably, the diameter is 7/16 inches or ⅝ inches. However, a person of ordinary skill in the art would understand that the shape, thickness and diameter of the burst disk may vary.

The thickness of the remaining wall defining the burst disk, the diameter of the burstable disk 20*a*, and the material of the burst disk will determine the magnitude of burst pressure. For example, according to one embodiment of this invention, a burstable disk diameter of about ⅝ inches and a burstable disk wall casing thickness of 0.01 inches results in a burst pressure of about 3,000 psi to about 4,000 psi using L-80 casing.

The burstable disk is preferably made of type 302 stainless steel, however the burst disk can be made of any suitable material that could withstand the pressures described in this invention. For example, the burst disk can be made of plastic or other metals such as an alloy, stainless steel or other suitable material that can withstand the design pressures, or a material that dissolves upon contact with a dissolving fluid. An example of a dissolving fluid is an acid.

A person of ordinary skill in the art would understand that the shape and size of the burst disk and the port in which it is placed may vary.

Figure 2A:
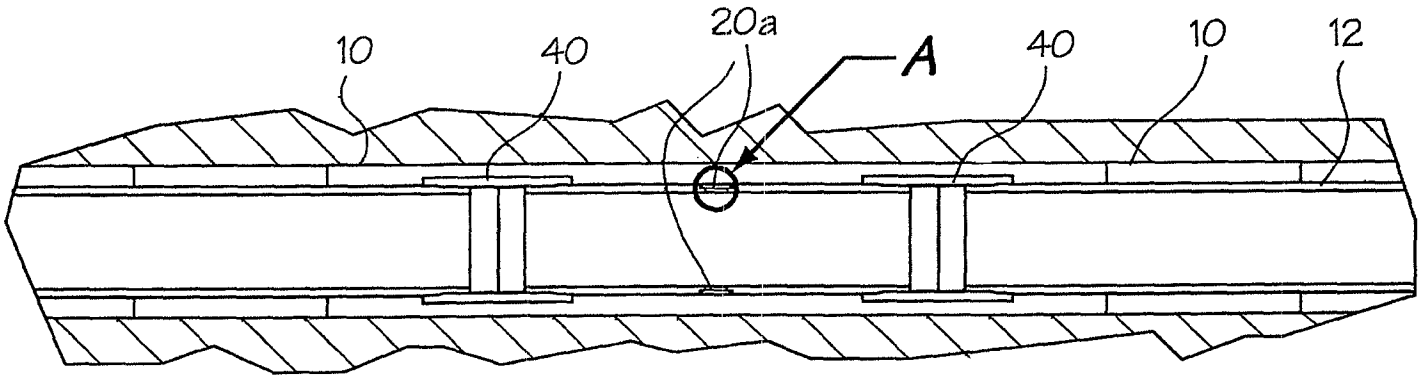
FIG. 2A is a drawing of a partial cross-section of a completion string without a tool therein in accordance with one embodiment of this invention.
Figure 2C:
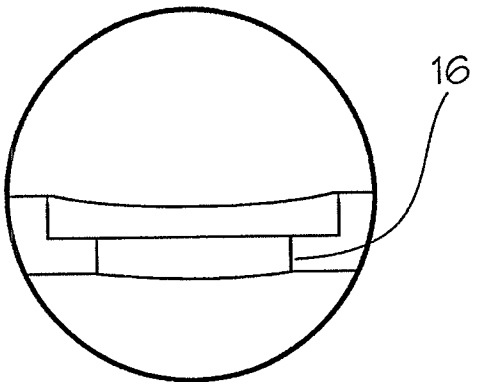
FIG. 2C is a cross-section Detail B of FIG. 2D showing a ruptured burst disk according to one embodiment of the invention.
Figure 2B:
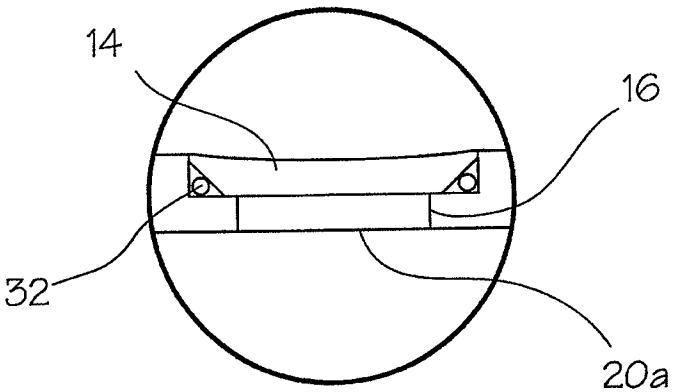
FIG. 2B is a cross-section Detail A of FIG. 2A showing a burst disk in place in a completion string according to one embodiment of the invention.
Figure 2D:
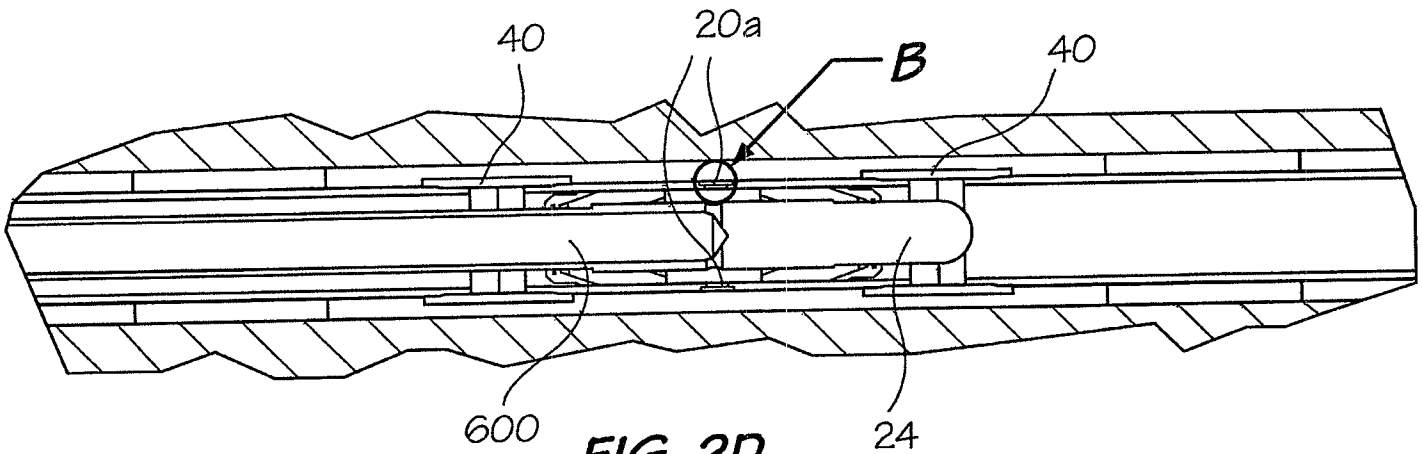
FIG. 2D is a drawing of a partial cross-section of a completion string with a tool therein in accordance with one embodiment of this invention.
Figure 3:
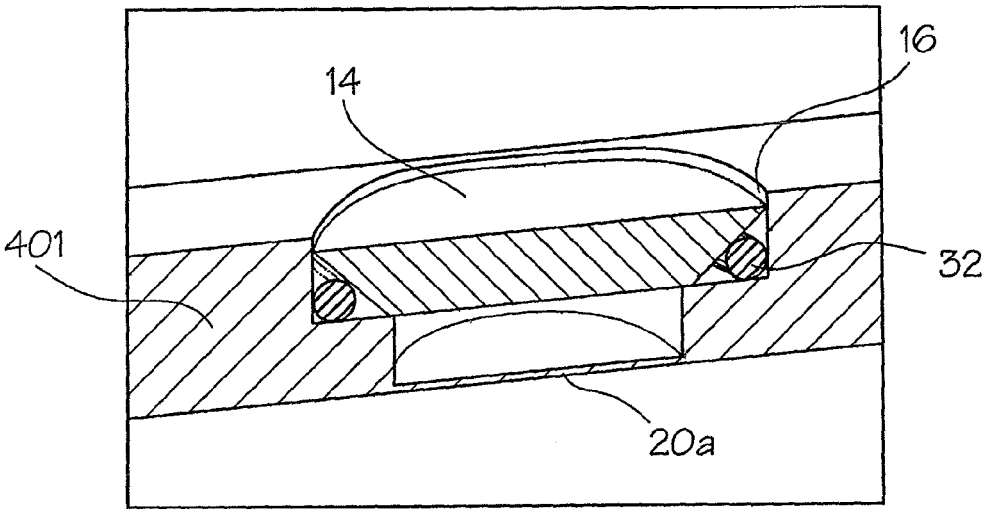
FIG. 3 is a drawing of a cut-away perspective view of a wall of a completion string with a burst disk in accordance with one embodiment of this invention.

FIGS. 2A and 2D show a cross section of the wellbore 10 lined with a completion string 12. FIG. 2D depicts a well treatment tool indicated generally at 600 positioned within the completion string 12. In another embodiment of this invention, the burst disks 20*a* are formed from the wall of the completion string 12. At intervals along the length of the completion string 12, the wall is thinned at certain points by machining. Preferably, the points are formed radially on the circumference of the tube 12. However, the points can be arranged in any other desired pattern. In one embodiment, the thickness of the thinned wall section is 0.01 inches but the thickness of the wall can vary depending upon the materials used and the desired burst pressure. This is achieved by boring partway through the wall of the completion string to create a port 16 having a burstable disk 20*a* as a base. Each thinned wall section defines a burstable disk. More preferably, the port 16 is counter-bored.

FIG. 3A shows a partial-section of the port 16 in the wall 401 of a completion string such as completion sting 12 where the burstable disk 20*a* is formed integrally with the completion string. The wall of the burstable disk 12*a* of the completion string 12 is preferably counter-bored such that a counter-bore of greater diameter extends approximately half-way through the wall of the treatment tube, and a second bore of smaller diameter is made within the first bore to create a thinned wall section forming the burstable disk 20*a*. Preferably, the bores are made perpendicular to the longitudinal wall of the completion string, however this is not necessary. A person of ordinary skill in the art would appreciate that the order of boring the bore and counter-bore does not matter. The bore does not penetrate through the wall of the burstable disk 12*a*. Between the protective cover 14 and the thinned wall of the burstable disk 20*a* is a space at atmospheric pressure.

As shown in FIG. 3C, a protective cover 14 is preferably peened in place to entirely cover the area of the port 16. The cover 14 may be held in place by other means. For example, the cover 14 can be press fit or held in place by means of an O-ring (as in FIG. 2B for example) or some other similar method such as threading. The protective cover 14 creates a tight fit against the rim of the port 16 such that fluid is prevented from flowing between the annulus and the interior of the completion string. The port 16 remains closed prior to rupture.

Capping the port with a protective cover 14 serves several purposes. The cover 14 creates an air pocket of about atmospheric pressure between the outside of the burst disk and the inside of the cover 14. The space between the burst disk and the cover 14 is sealed and the space remains at or close to atmospheric pressure until the disk bursts. This facilitates bursting of the disk because it bursts against about atmospheric pressure and ensures that a predictable pressure will burst the disk. Furthermore, without the cover 14, the burst disks may not rupture simultaneously. If one burst disk were to rupture before the others, then fluid will flow out of that first ruptured port and the pressure will equalize between the inside and in the space exterior to the completion string, such as completion string 12 in which the burstable disk 20*a* is housed. The cover 14 prevents the pressure from rupturing the other disks from the outside in, which would cause fluid to flow into the tool. Preferably, as shown in FIG. 2B, the protective cover is fitted with an O-ring 32 to further ensure no leak path is present for fluids to pass.

Figure 4A:
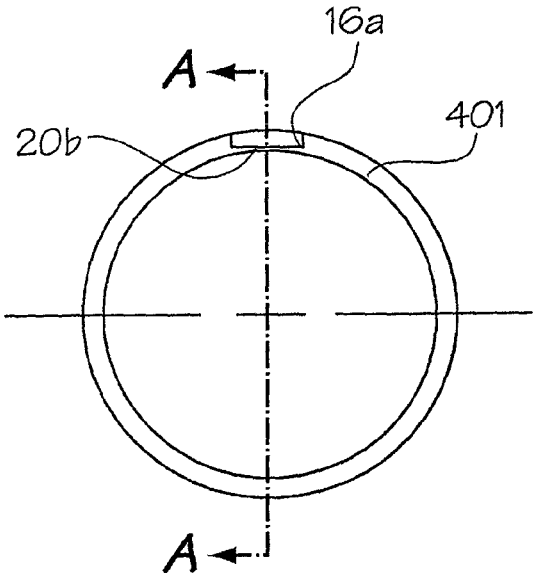
FIG. 4A is a drawing of an end cross section view of a completion string having a burst disk in accordance with one embodiment of this invention.
Figure 4B:
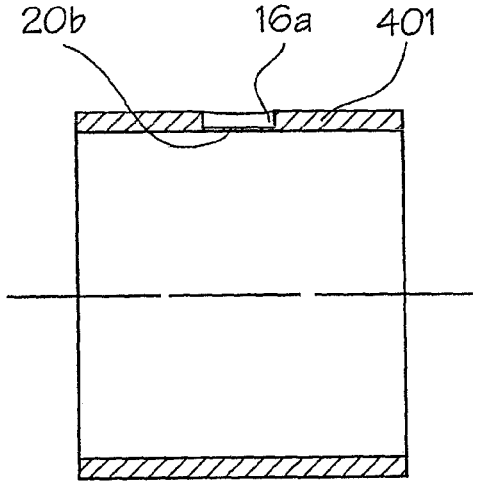
FIG. 4B is a drawing of a cross-sectional view of the completion string taken along the line A-A in FIG. 4A.
Figure 5A:
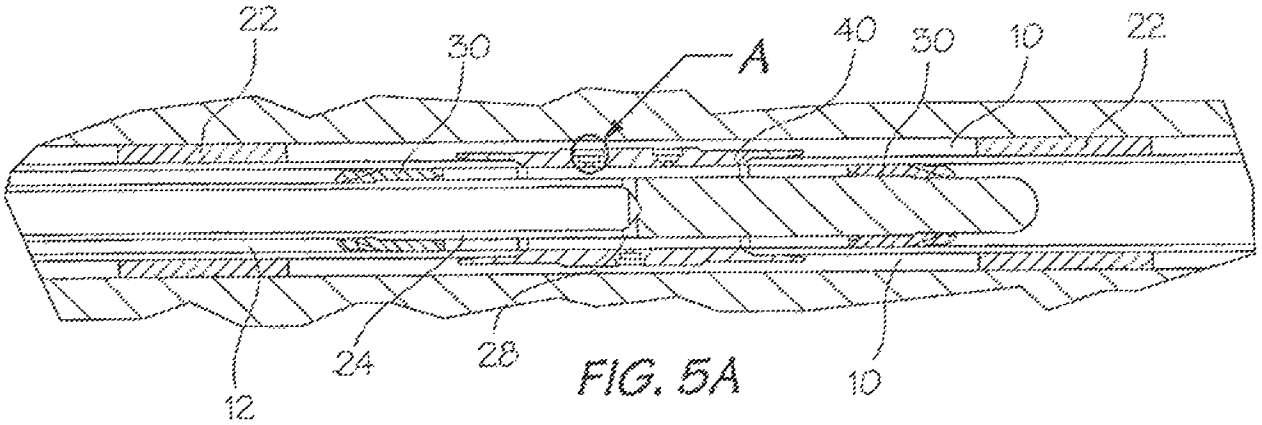
FIG. 5 is a drawing of a cross-sectional view of a wellbore and completion string having burst disks in a collar according to one embodiment of this invention.
Figure 5B:
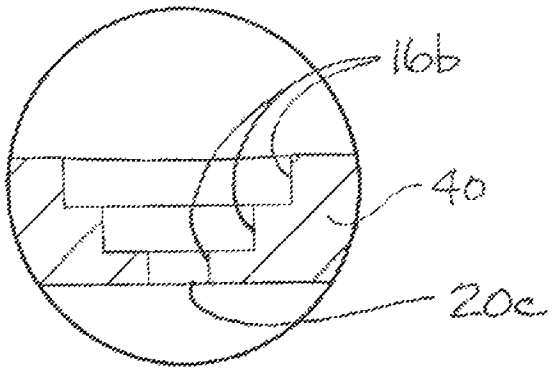
Figure 6A:
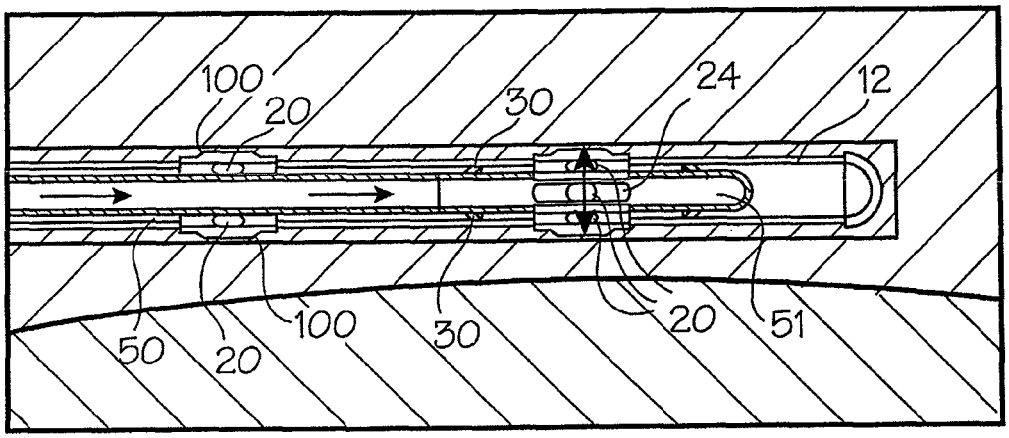
FIG. 6A is a drawing of the cross-section of an enlarged portion of the wellbore and completion string of FIG. 1B with fluid pumping down the treatment tubing.
Figure 6B:
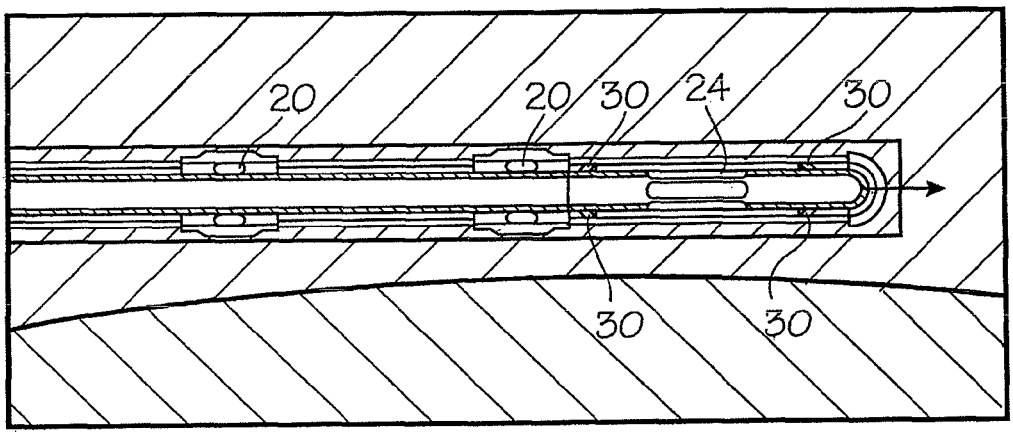
FIG. 6B is a drawing of the cross-section of the wellbore and completion string of FIG. 6A with the tool re-positioned downhole.
Figure 6C:
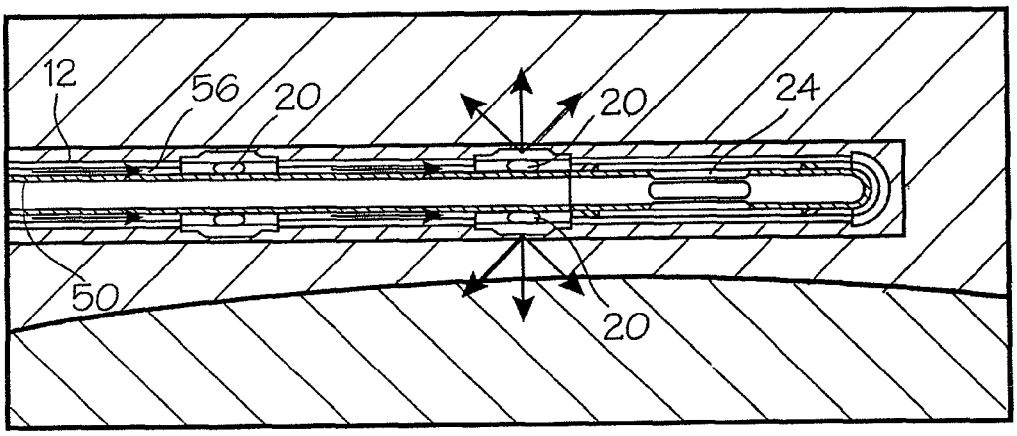
FIG. 6C is a drawing of the cross-section of the wellbore and completion string of FIG. 6A with fluid flowing from an annulus and out the ruptured burst disks.
Figure 6D:
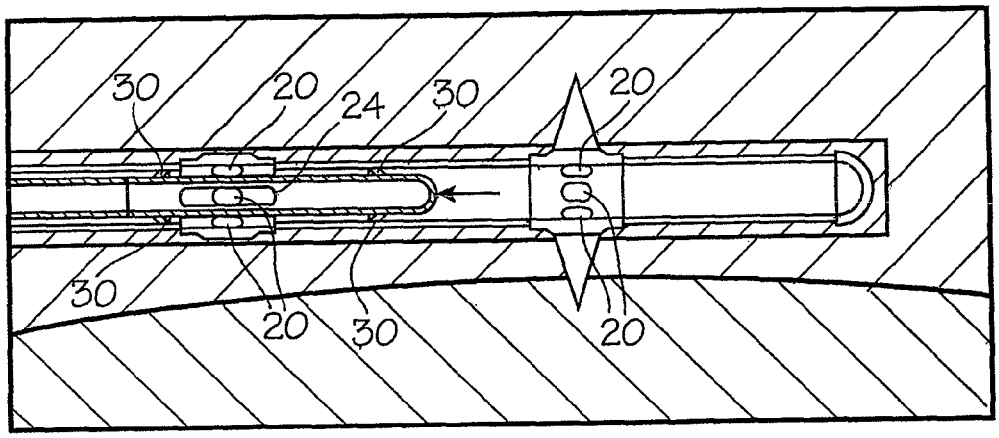
FIG. 6D is a drawing of the cross-section of the wellbore and completion string of FIG. 1A with the tool re-positioned uphole at a second zone.
Figure 6E:
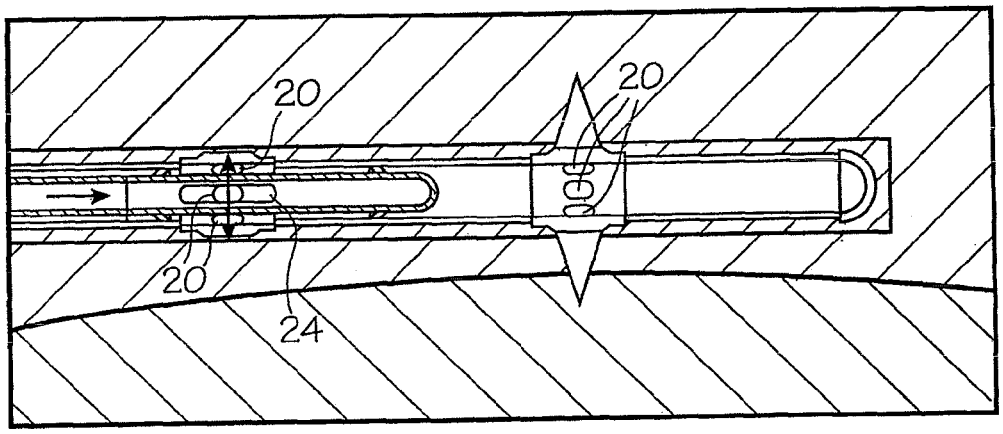
FIG. 6E is a drawing of the cross-section of an enlarged portion of the wellbore and completion string of FIG. 6D with fluid pumping down the treatment tubing.
Figure 6F:
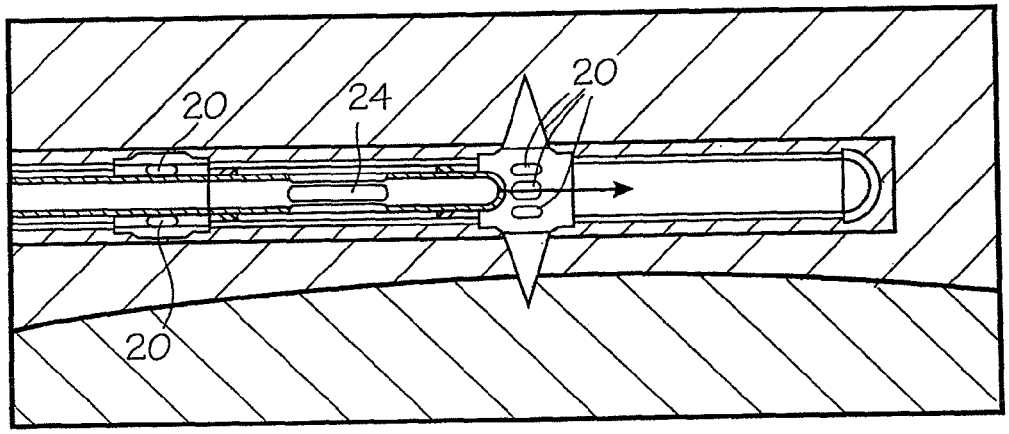
FIG. 6F is a drawing of the cross-section of the wellbore and completion string of FIG. 6D with the tool re-positioned downhole from the second zone.
Figure 6G:
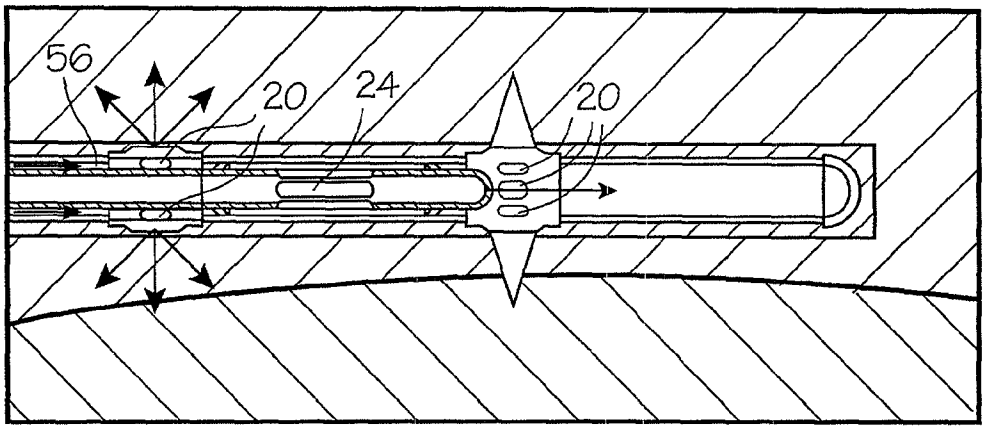
FIG. 6G is a drawing of the cross-section of the wellbore and completion string of FIG. 6D with fluid flowing from an annulus and out the ruptured burst disks at the second zone.

Referring to FIGS. 4A and 4B, in one embodiment of this invention, the burstable disk 20*b* is made from a single bore in the wall of the completion string 12. The port 16*a* for the burstable disk 20*b* is shown without a protective cover.

Burst disks suitable for use in this invention can also be of the conventional type used in the art, for example, the burst disks supplied by Benoil™. If conventional burst disks are used, they can be built into or installed into a completion string and/or collars by conventional methods and used according to the methods described herein.

Completion strings and collars having burstable disks according to the invention can cemented or used in an open hole condition. The completion string 12 and collars 40 can be cemented to the wellbore 10 by filling the annular space 500 between completion string 12 and collars 40 and the wellbore 10. This is commonly known as the cemented condition. Using cement can substitute for the need for packers or other interval isolation devices.

When a completion string with burst disks is cemented into place, an interval of the completion string 12 that has the burst disks 20, can be covered by a shield (not shown) to prevent cement from sealing in the burst disks. A shield can also be used to cover burst disks in a collar if a collar of the type shown in FIG. 12 is used.

The shield provides for a space to be maintained between the completion string and the wall of the wellbore to allow cement to flow continuously along the entire length of the completion string. The pressure exerted by the treatment fluid would be enough to fracture through the layer of cement that would have formed. Alternatively, in another embodiment, the completion string could be resting against the wellbore and, therefore, cement does not completely encircle the completion string allowing the burst disk ports to contact the wellbore. The pressure exerted by the treatment fluid would be enough to fracture directly into the formation.

Referring to FIG. 12B, in another embodiment, the use of a shield can be avoided by using a collar where the central section of the collar includes fins 100 radially positioned around the circumference of the collar. The fins protrude outwardly from the wall of the burst disk collar thereby decreasing the space between the collar and the wellbore and centralize the completion string in the wellbore.

To cement a completion string with a collar having fins in place, cement is pumped between the wellbore and the outside diameter of the completion string, through a void commonly known as the annulus. Fins 100 are arranged so that there are slots between them such that cement can pass by and continue to fill the annulus. Once the cement is cured, the subterranean hydrocarbon bearing formation, completion string, and collar(s) are rigidly connected to each other. In one embodiment of the invention, the projection of the fins 100 ensures that very little cement is between the fin 100 and the subterranean hydrocarbon bearing formation. The cement used for filling the annular space may have special properties to make it more suitable for the downhole environment and in one embodiment of the invention the cement may be acid soluble, unlike conventional cement used in oilfield operations. Each collar carries at least one burst port located within the fin 100.

As a result, once cement fills the space between the completion string and wellbore, the portions of cement 500 adjacent the fins are thin enough such that treatment fluid can burst through the cement 500 when the burstable disks 148 rupture, as shown in FIGS. 10A to 10E.

A person of ordinary skill in the art would understand that this technique of cementing the completion string to the wellbore, as taught by this invention, can be applied to treatment methods that use other conventional burst disks and sliding sleeves.

The method of hydrocarbon bearing formation stimulation of one embodiment of this invention involves stimulating a hydrocarbon bearing formation by pumping treatment fluid under pressure through a treatment tubing and treatment tool. Prior to carrying out this method, the interval of the wellbore to be fractured must be isolated by conventional methods. The spacing between intervals would differ depending on the well, however typically, they may be spaced about every 30-50 meters. Hydraulic isolation in the exterior annulus can be achieved by having the completion string either cemented into position or by having external packers or other annular sealing device running along the longitudinal length of the completion string. Suitable annular sealing devices include cups and packers, and are well known in the art.

Referring to FIGS. 1A to 1G, a method according to one embodiment of this invention involves first passing a completion string 12 down a wellbore 10, and then passing a bottom hole assembly 51 connected to treatment tubing 50, such as a coiled tubing or jointed pipe, inside the completion string 12. Bottom hole assembly 51, is further described with reference to FIGS. 11A-11D. The tool 51 carries radial passages along its circumference such that the interior of the treatment tubing 50 is in fluid communication with the exterior of the treatment tubing string 50. The tool 51 should then be positioned in a suitable location for treating the formation. The suitable location would be the position such that the pressure isolation devices (one of which is shown as 30), such as packers or packer cups, straddle one or more burst disk assemblies. In this position, treatment fluid that is pumped under pressure through the bore of the treatment tubing 50 and into a cavity defined between the isolation devices 30; causing a sufficient increase in pressure at the area of the burst disks so as to rupture the burst disks between the pressure isolation devices 30.

In a cemented environment, once the burst disks rupture, the treatment fluid fractures the cement, and then can reach the formation to stimulate or fracture it. The treatment fluid can be pumped at a pressure between about 100 psi and about 20,000 psi to rupture the disks but other suitable pumping pressures are also possible. Preferably, pressure is applied at about 100 psi to about 10,000 psi. More preferably, pressure is applied at about 3,000 psi to about 4,500 psi. In this invention, stimulation can begin anywhere along the completion string where burst disks are located and there need not be any pre-defined order of treatment. For example, stimulation can occur at the distal end of the completion string first and then moved up hole, or in the reverse order, or stimulation can start partway down the wellbore and then proceed either up or downhole. This also allows some of the burst disks to be opened in one treatment and others to be left for treatment at a later date.

Therefore, following treatment, the treatment tubing, and hence the tool, can be moved up or down hole to straddle another set of burst disks. Each set of burst disks placed in the treatment tubing can be treated independently as successive treatments are isolated from each other. As such, each isolated interval of formation can also be treated separately.

Since the interval is isolated, pressure builds within the completion string very quickly. Furthermore, the same pressure can be applied for each treatment. The operation is further simplified because, unlike other methods in the art, each burst disk can be identical and having the same pressure threshold.

Referring to FIGS. 6A to 6G, in another embodiment of this invention, the formation is stimulated by pumping treatment fluid under pressure in an annulus 56 between the treatment tubing 50 and completion string 12, rather than through the treatment tubing 50 and the treatment tool 51. The cross sectional area of the annulus 56 is greater than the cross sectional area of the treatment string 50, so higher pumping rates can be achieved, which is vital for some operations.

The treatment tool 51 with isolation devices 30 can be used to isolate an interval within the completion string. Further, the wall of the completion string 12 similarly has collars 40 which carry burst ports 20 arranged therein as described in above described embodiments. The treatment tool 51 is first positioned such that the isolation devices 30 straddle a set of burst disks. As more particularly shown in FIG. 6A, treatment fluid or any useful fluid is then pumped into the treatment string 5) and ejects out of the opening 24 of the treatment tool 51 to rupture the burst disks in the ports 20. However, in this alternative embodiment shown in FIG. 6G, once a set of burst disks are ruptured, the treatment tool 51 and isolation devices 30 are moved downhole from the set of ruptured disks. Treatment fluid is then pumped downhole under pressure in the annulus 56 between the treatment tubing 50 and completion string 12, rather than through the treatment tool 51. Once the treatment fluid reaches the ruptured burst disks in the ports 20, it will exit the completion string 12 and stimulate the adjacent formation. The treatment tool 51 and therefore, the isolation devices 30, are situated downhole from the set of burst ports 20 to prevent the treatment fluid from fracturing any area downhole of the set of burst ports 20. The steps of this method can be repeated after moving the treatment tool uphole to the next set of burst disks to be ruptured by the treatment tool.

Figure 7A:
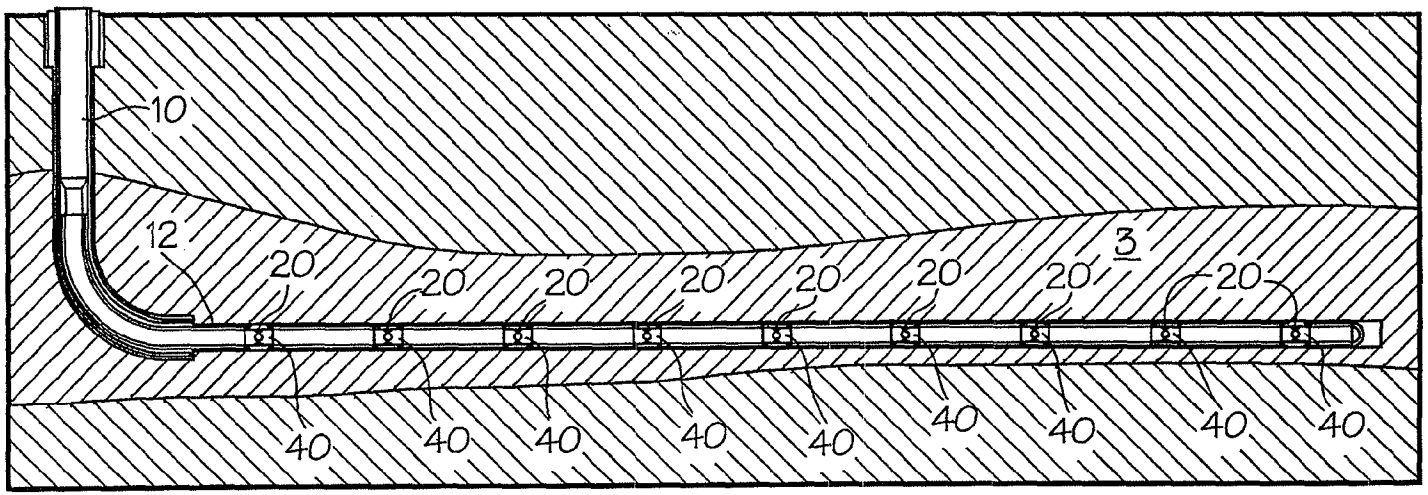
FIG. 7A is a drawing of a cross-section of a wellbore and a completion string having burst disks in accordance with another embodiment of this invention.
Figure 7B:
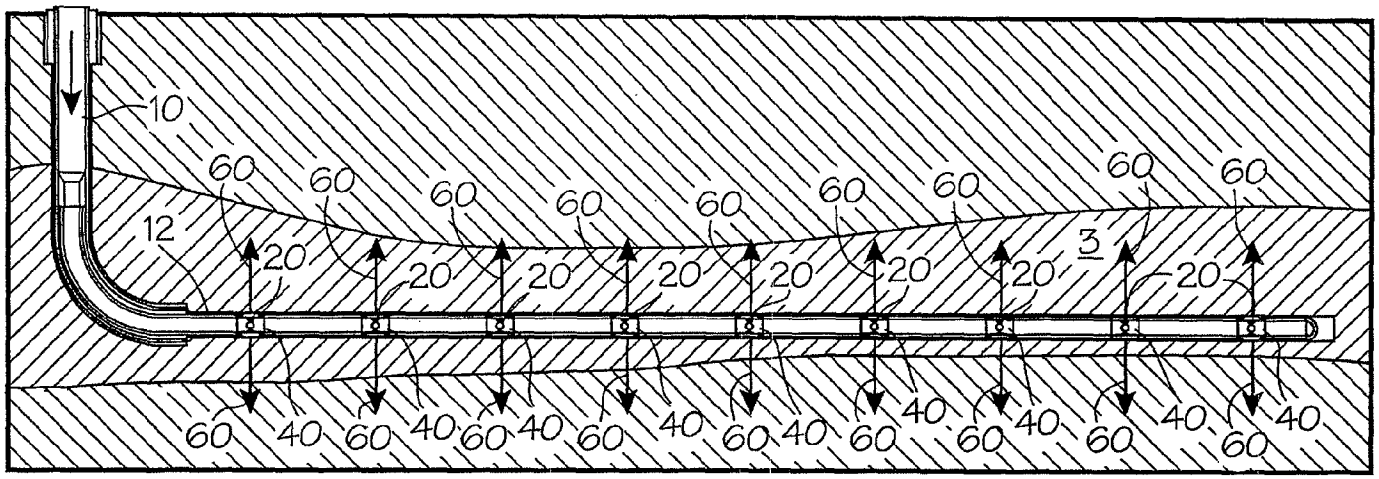
FIG. 7B is a drawing of a cross-section of a wellbore and a completion string of FIG. 7A with fluid pumping down the completion string and burst disks ruptured.

Referring to FIGS. 7A and 7B, in another embodiment of this invention, isolation devices are not needed; treatment fluid is pumped down the completion string from surface and all the burst ports can be subject to the treatment fluid pressure simultaneously, and will also rupture simultaneously. As indicated by arrows 60, the treatment fluid will then flow into the hydrocarbon bearing formation 14 from the ports 20 at the same time.

Figure 8A:
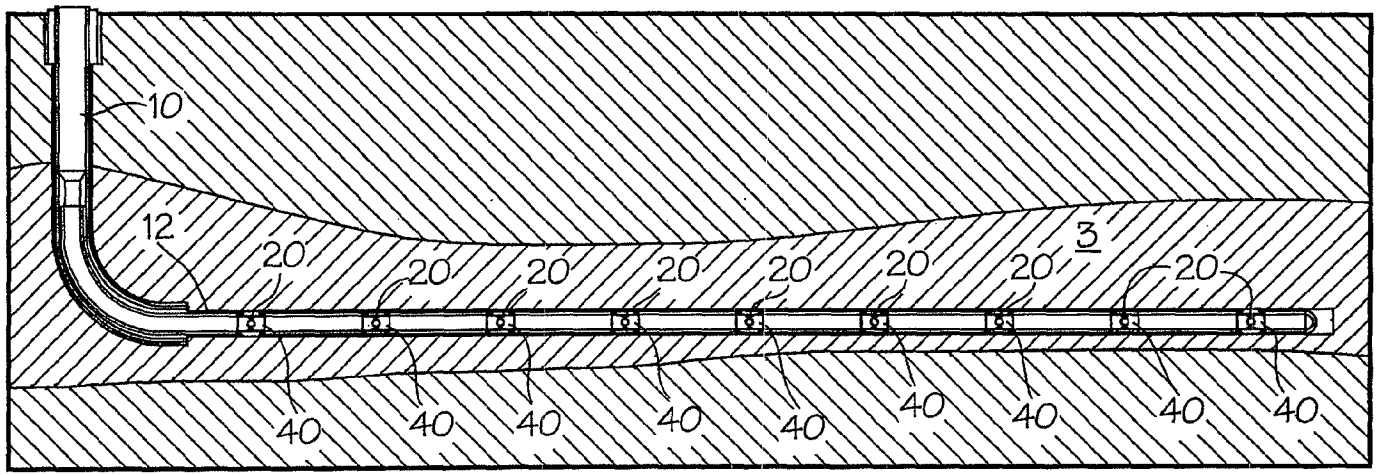
FIG. 8A is a drawing of a cross-section of a wellbore and a completion string having burst disks in accordance with another embodiment of this invention.
Figure 8D:
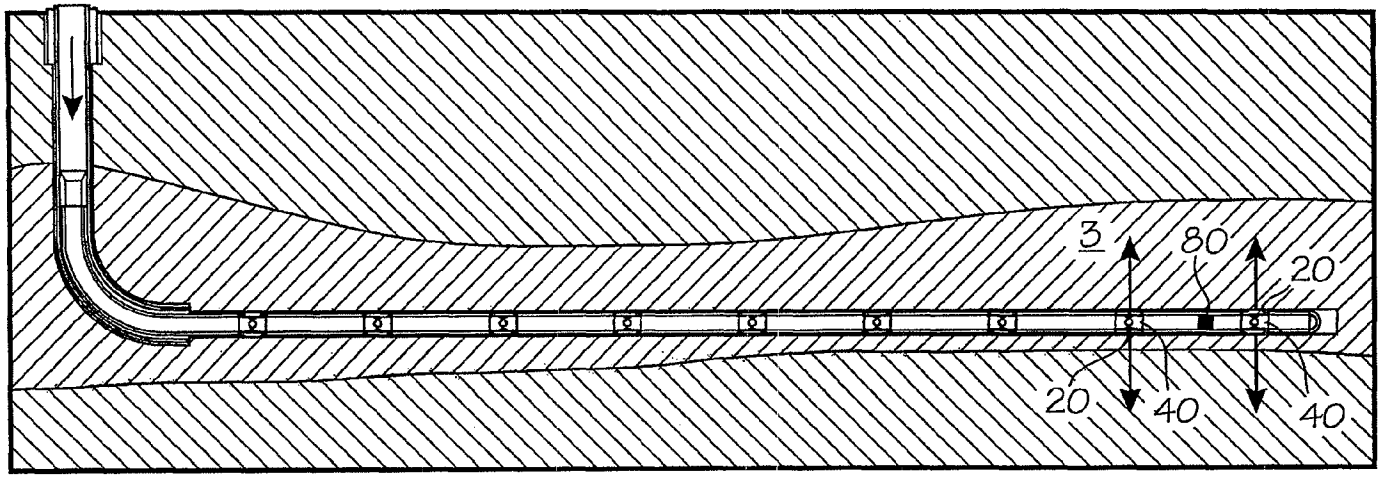
FIG. 8D is a drawing of a cross-section of a wellbore and a completion string of FIG. 8A with fluid pumped down the treatment tubing burst disks at a second zone ruptured.
Figure 8E:
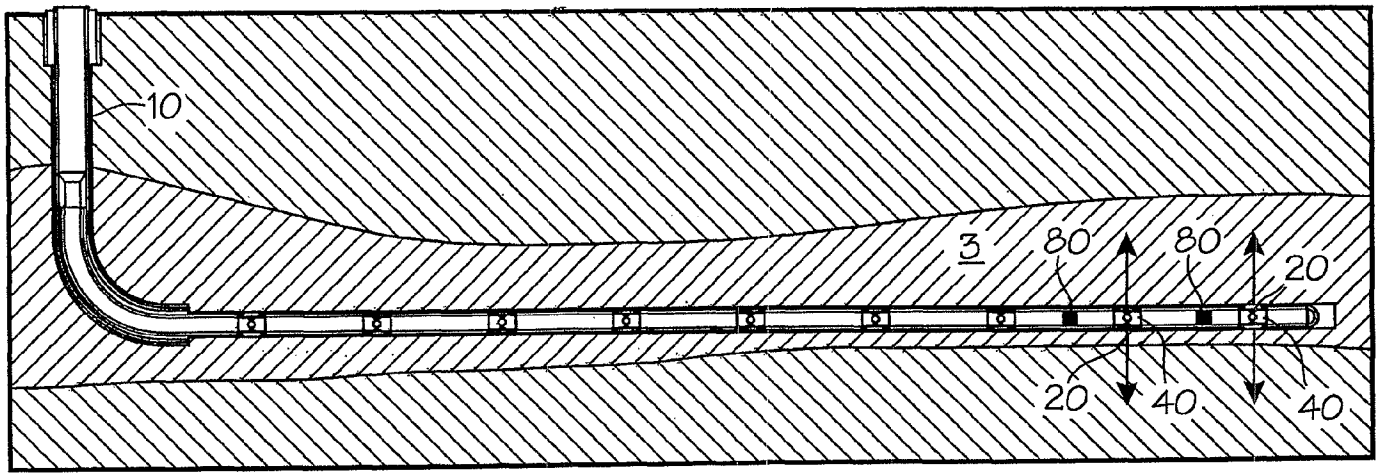
FIG. 8E is a drawing of a cross-section of a wellbore and a completion string of FIG. 8A with a sealing device uphole from the second zone.
Figure 9A:
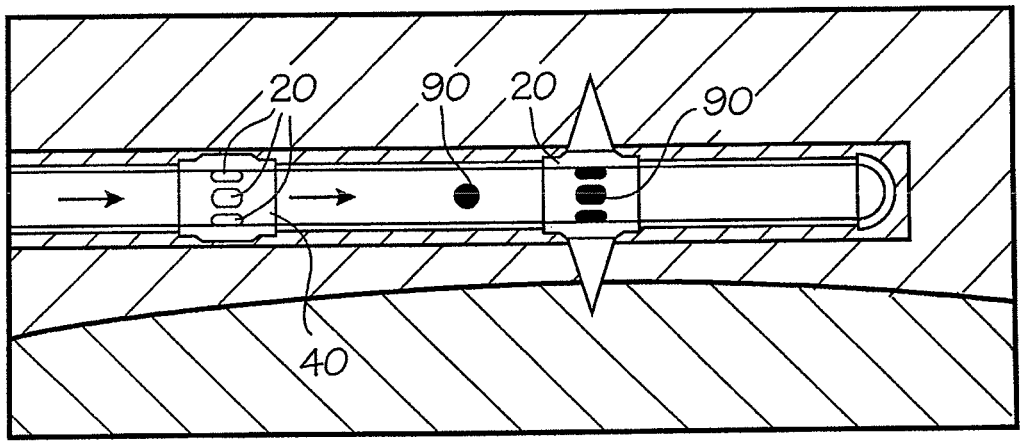
FIG. 9A is a drawing of a cross-section of a wellbore and a completion string with frac balls pumping down the completion string and sealing ruptured burst disks at a first zone according to one embodiment of the invention.
Figure 9B:
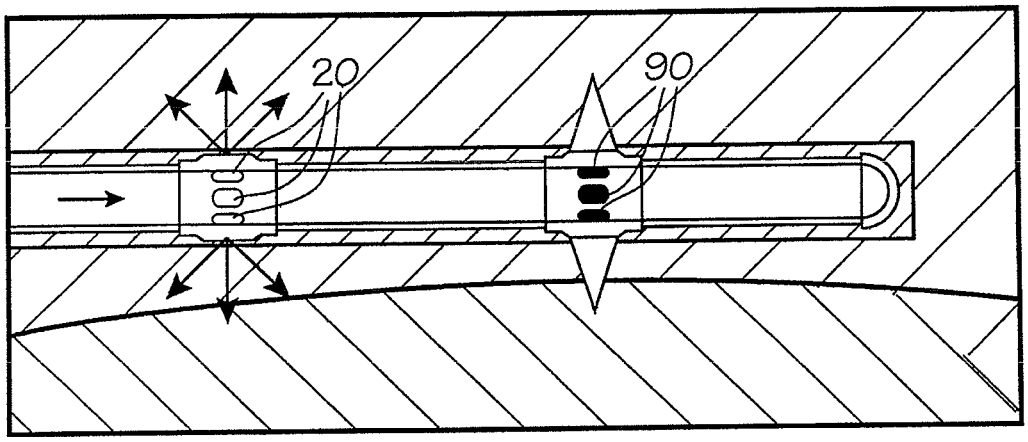
FIG. 9B is a drawing of a cross-section of a wellbore and a completion string of FIG. 9A with fluid pumping down the completion string and burst disks at a second zone ruptured.
Figure 9C:
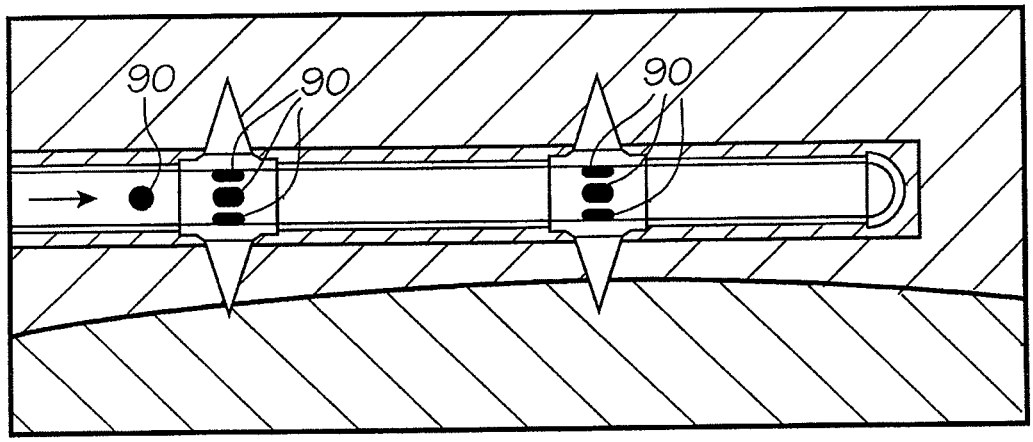
FIG. 9C is a drawing of a cross-section of a wellbore and a completion string of FIG. 9A with frac balls pumping down the completion string and sealing ruptured burst disks at a second zone.
Figure 10A:
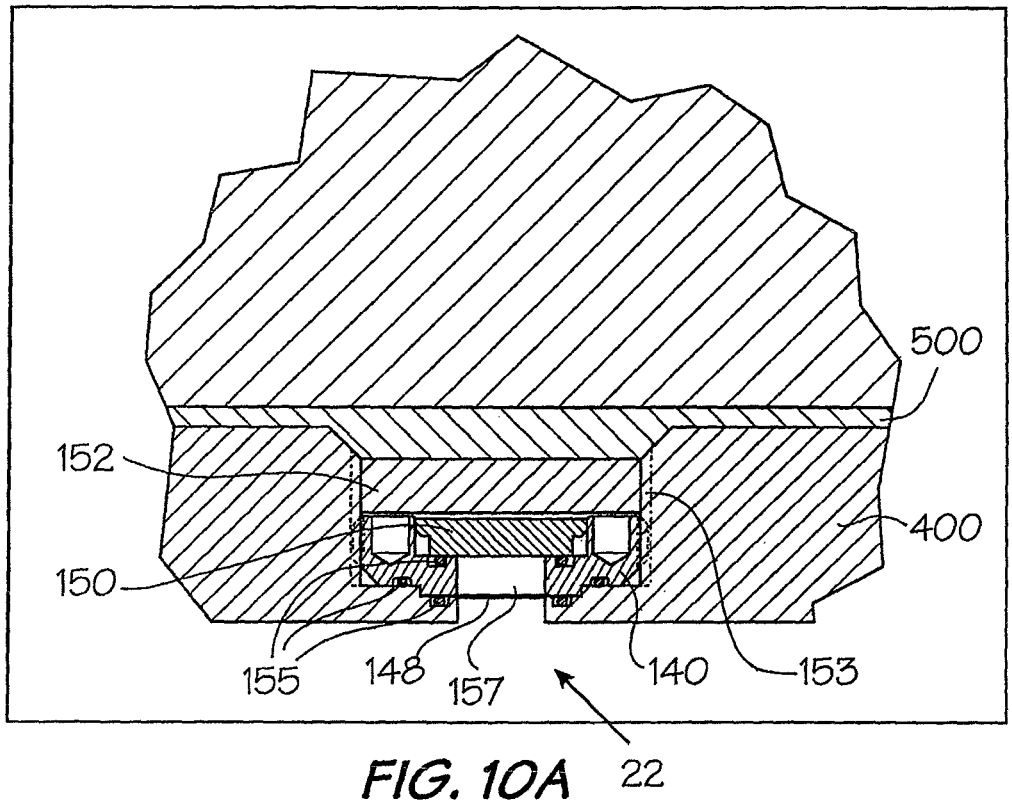
FIG. 10A is a partial cross-sectional view of a burst disk assembly in a collar cemented to a wellbore according to another embodiment of the invention.
Figure 10B:
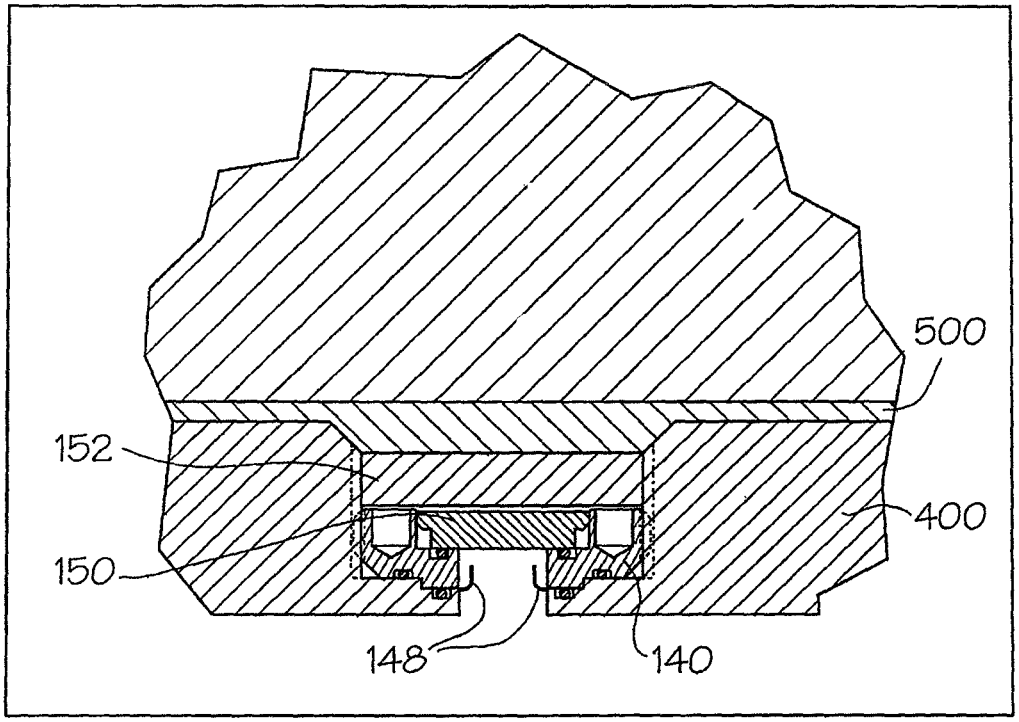
FIG. 10B is a partial cross-sectional view of the burst disk assembly in FIG. 10A having a ruptured burst disk.
Figure 10C:
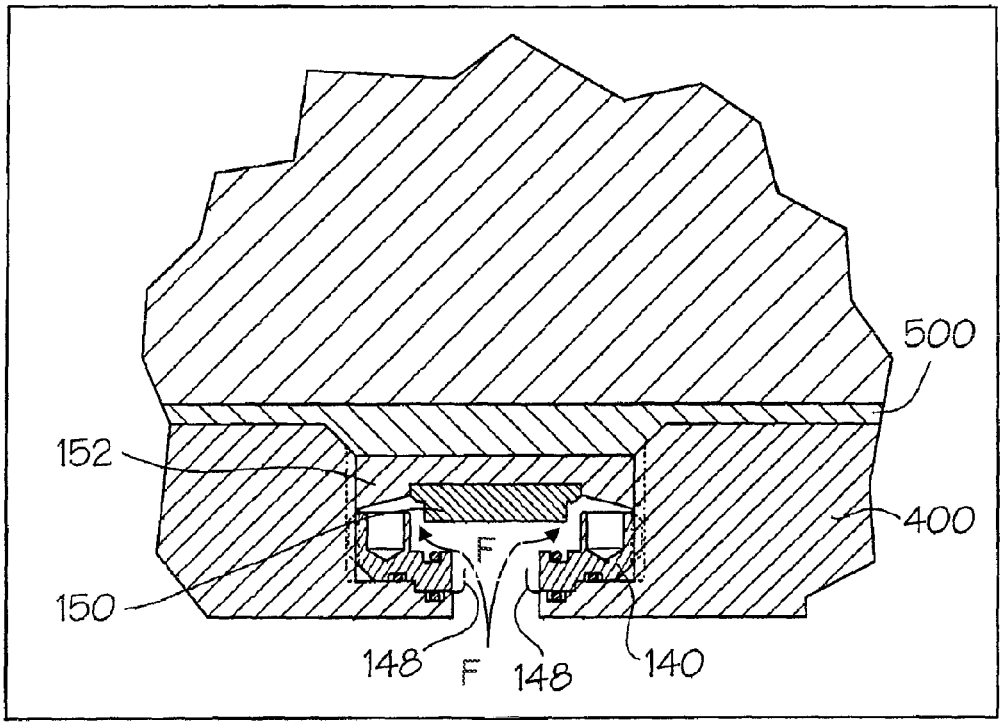
FIG. 10C is a partial cross-sectional view of the burst disk assembly in FIG. 10A with an unsecured cap.
Figure 10D:
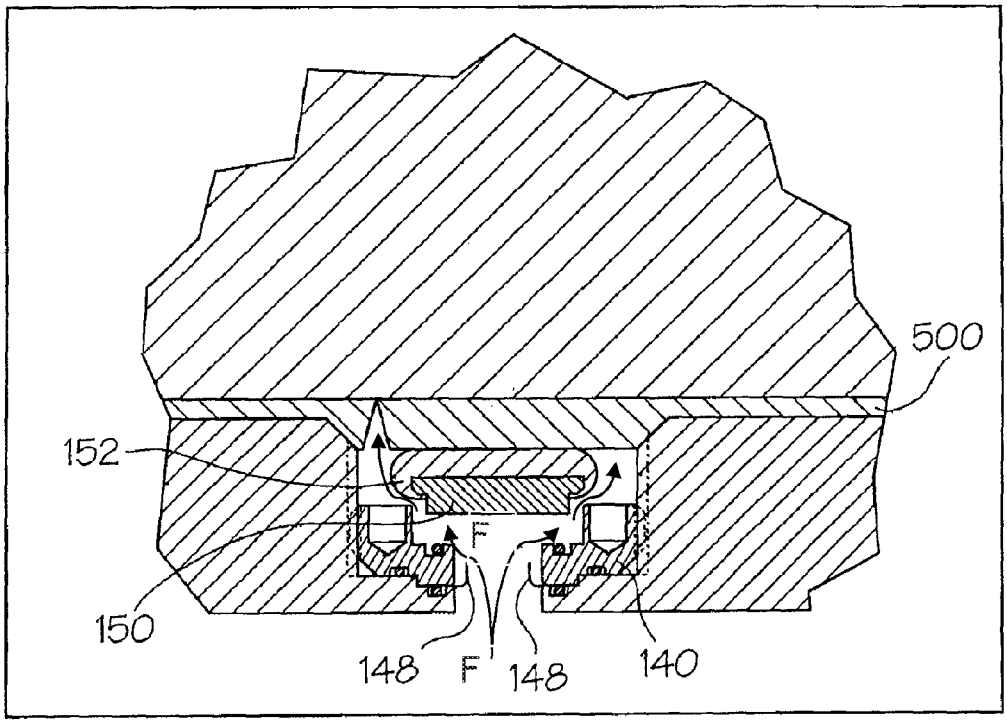
FIG. 10D is a partial cross-sectional view of the burst disk assembly in FIG. 10A that has ruptured through the cement.
Figure 10E:
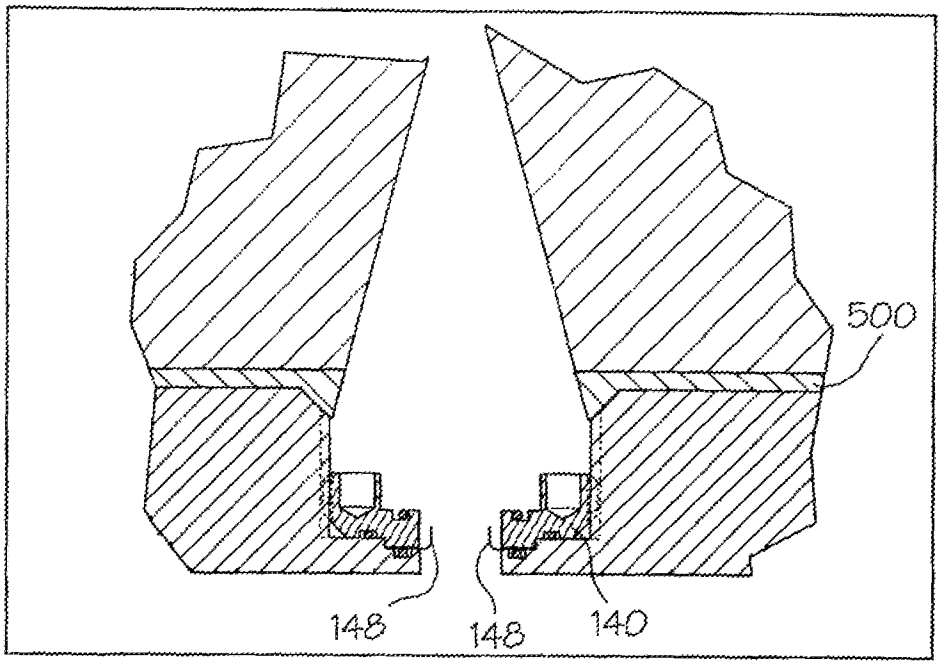
FIG. 10E is a partial cross-sectional view of the burst disk assembly in FIG. 10A that has ruptured through a formation.

Referring to FIGS. 8A to 9E, in another embodiment of this invention, burst disks mounted in collars (20) with different burst pressure thresholds can be set such that a series of burst disks rupture in a staggered manner according to various fluid pressures being applied. FIG. 8A shows the completion string 12 inserted in the wellbore and ready for stimulation operations. Burst pressures at each burst disk can increase uphole with the burst disk at the toe of the wellbore set with the lowest burst pressure. Treatment fluid is then pumped down the completion string to rupture the burst disk and continuously pumped to stimulate the first interval located at the toe of the wellbore, as shown in FIG. 8B. Once the first interval is stimulated, it is isolated from fluid communication with the remainder of the completion string 12. This isolation can be achieved by setting a sealing device 80 between the burst disks in the first interval and the next interval to be stimulated, as shown in FIG. 8C. The next interval can then be stimulated, as shown in FIG. 8D. The sealing device 80 can be a packer or other device known in the art. Another way to isolate the interval is by pumping frac balls 90 or particulate material down the completion string, which block the passageway though the ruptured burst disks, as shown in FIG. 9A. The next interval would be situated uphole from the first zone. The steps are then repeated for stimulating the next interval and subsequent interval, as shown in FIG. 8E. The sequence need not start at the distal end of the completion string, the burst disks can be ruptured in any order. During wellbore completion operations, it is sometimes necessary it insert an array of different tools in the wellbore to perform different functions. The most cost effective way to insert these tools in a wellbore is typically on a wireline for easy insertion and removal of the tool. In order to insert wireline borne tools in a horizontal wellbore, the ports in the toe of the wellbore are ruptured, as shown in FIG. 8B. This provides communication with the formation and allows wireline tools to be pumped down the wellbore, which would be impossible if the distal end of the wellbore was sealed.

The method described with reference to FIGS. 8A to 9C can be practiced if the wellbore is cemented with only a completion string present and to pump treatment fluid through the completion string; with a treatment string present and to pump treatment fluid through the treatment string; or to pump through the annulus between the completion string and the treatment string, as described in the embodiments above.

Another embodiment of this invention involves the use of burst disks, as disclosed in this application, in enhanced oil recovery, for example SAGD or VAPEX. Typically, there would be a pair of horizontal injection and producing wells. Burst disks located in the walls of a completion string fed down the injection well would rupture under the pressure of steam or solvent being pumped into the injection well. The steam or solvent liquefies the oil situated between the pair of horizontal wells. Burst disks located in the walls of a completion string fed down the producing well would then be ruptured under pressure, allowing the liquefied oil to migrate into the producing well through the ruptured burst disks and later collected from the producing well.

In an alternative embodiment, the completion string is inserted into the wellbore and cemented to the hydrocarbon bearing formation. In place of periodically spaced collars carrying burst disks the completions string can be locally provided with communication with the cement. Examples include but are not limited to, conventional burst disks, sliding sleeves and/or any method of opening a port in the completion string wall; having the completion string wall reduced in thickness or even completely to partially removed by any means to create a region of low to zero strength in the completion string wall. The wall material of the completion string can be removed by cutting, machining, abrading, chemical removal, or other means. The resultant region of low to zero strength will allow fracturing through the cement thus behaving-similarly to a burst disk and allow the treatment fluid to stimulate the subterranean hydrocarbon bearing formation when the treatment fluid is pressurized in accordance with any of the methods described above. Alternatively, the cement can be acid soluble, and in place of high pressure the stimulation is initiated by an acid spearhead. Some pressure would be needed to either rupture the burst disks or penetrate a region of low strength of the completion string wall, but the pressure is much lower than would be used in a pressure initiated stimulation treatment.

All of the above embodiments are generally described in terms of the completion string being cemented to the hydrocarbon bearing formation. It is possible to use the above described invention in an open hole, however isolation devices must be used between the outside of the completion string and the hydrocarbon bearing formation to hydraulically isolate the area to be stimulated, such that the treatment fluid will flow from the bore of the string that contains treatment fluid, through the ruptured burst ports, and into the formation. If the exterior annular isolation devices were not present the treatment fluid may not flow where desired.

Referring to FIGS. 11A to 11D, a bottom hole assembly (BHA) 51 is used on the distal end of the treatment string such as treatment string 50. When inserting the BHA 51 into a wellbore, the wellbore is normally filled with a service fluid (often this is water). To insert the tool 51 on a treatment string in to a wellbore the service fluid must be displaced. Service fluid flows through ports 100, through central passage 102, past seat 104 and out ports 106. It reenters the BHA 51 through ports 108 and continues out the BHA through central passage 110 and up the bore of the treatment tubing.

Figure 11A:
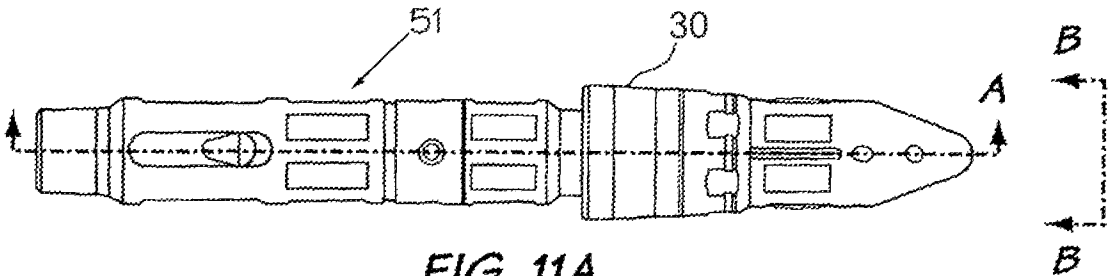
FIG. 11A is a cross-section of a frac tool pressure equalization valve according to one embodiment of this invention.
Figure 11B:
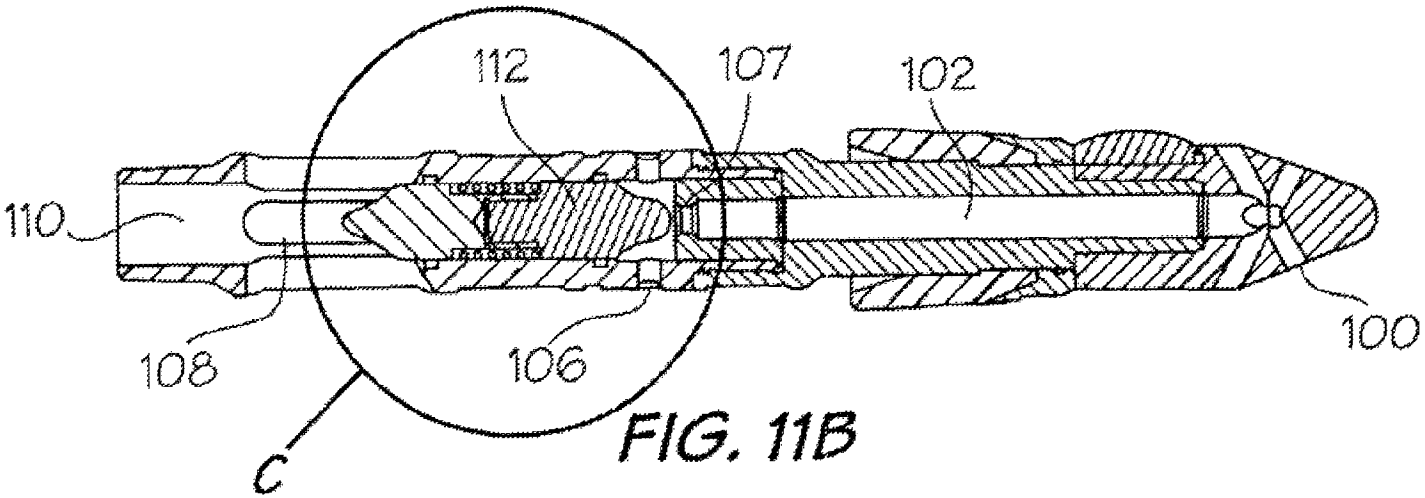
FIG. 11B is a cross-section of the valve of FIG. 11A taken along the line A-A.
Figure 11C:
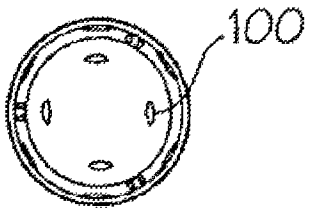
FIG. 11C is a front view of the valve of FIG. 11A taken along the line B-B.

When BHA 51 is being removed from the wellbore 10 the treatment string 50 is full of service or treating fluid, and the fluid must escape from the interior of the treatment string at a controlled rate. If the flowrate or pressure differential of the fluid exceeds a predetermined threshold, then the isolation elements 30 will set, causing the tool to seal against the interior of the completion string 12 wall, preventing removal of the tool. This is a desirable attribute when preparing for a stimulation operation and the isolation elements need to be set to achieve hydraulic isolation against the completion string 12, but not when attempting to remove the treatment string 50 and the BHA 51 from the wellbore 10. To remove the treatment tool 51, the treatment string 50 is removed from the wellbore 10 at a controlled rate, such that the differential pressure across piston 112 does not cause it to move and seal against seat 104. Sealing element 52 is shown in FIGS. 11A and 11C with the largest diameter portion facing left, there is a matching sealing element (not shown) attached to the left side of the BHA 51 that has the largest diameter portion facing right. In the area defined between the two sealing elements 30 are the ports 108 and piston 112.

Figure 11D:
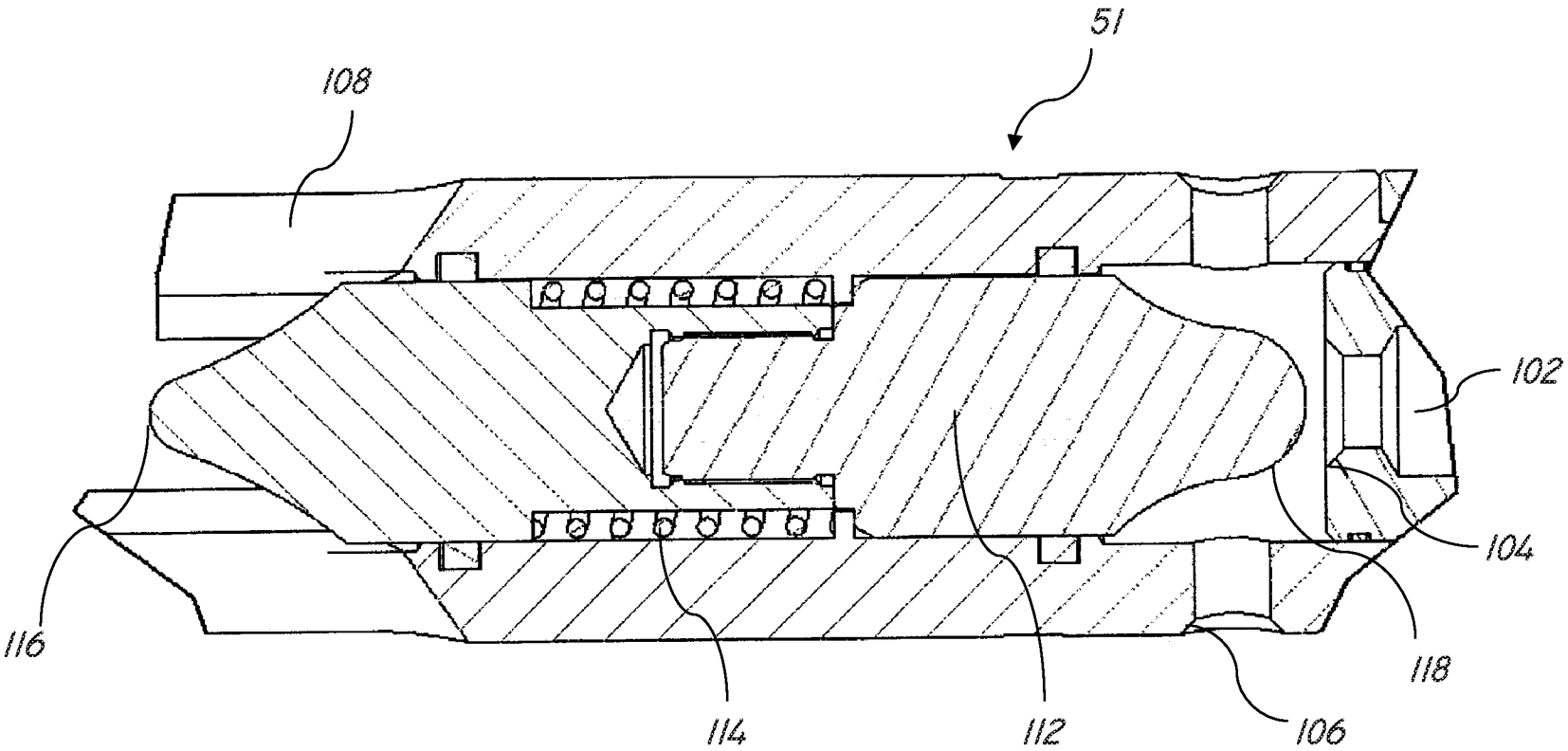
FIG. 11D is an enlarged view of section C in FIG. 11B.

Referring to FIG. 11D, in the piston area, as the fluid pumping rate is increased, differential pressure builds on the left face 116 of the piston 112 in the orientation shown, and is resisted by spring 114. As the pressure continues to build on the face 116, the spring is compressed as the piston 112 moves to the right. At a predetermined differential pressure, the right piston face 118 will contact the seat 104 and produce a fluid seal such that fluid flow from ports 106 to central passage 102 is prevented.

In a stimulation operation, as the pumping rate of treatment fluid increases the fluid moves out through ports 108 as the piston 112 has sealingly engaged seat 104 to prevent the fluid from flowing through the BHA. Instead, the fluid moves through ports 108 and forces the lips of the sealing elements 30 against the completion string 12 wall, creating a pressure tight seal. Port 108 is located between two isolation elements 30 which straddle a collar or other portion of the completion string 12 that has been partially or completely removed such that it is suitable for a formation stimulation operation, as described hereinabove. Once the treatment fluid has reached the critical pressure, it will then rupture the burst disks and stimulate the hydrocarbon bearing formation 3 according to the methods described hereinabove. The sealing portions of the valve are comprised of ceramic material (silicon nitride for the piston end and boron carbide for the seat).

Figure 1C:
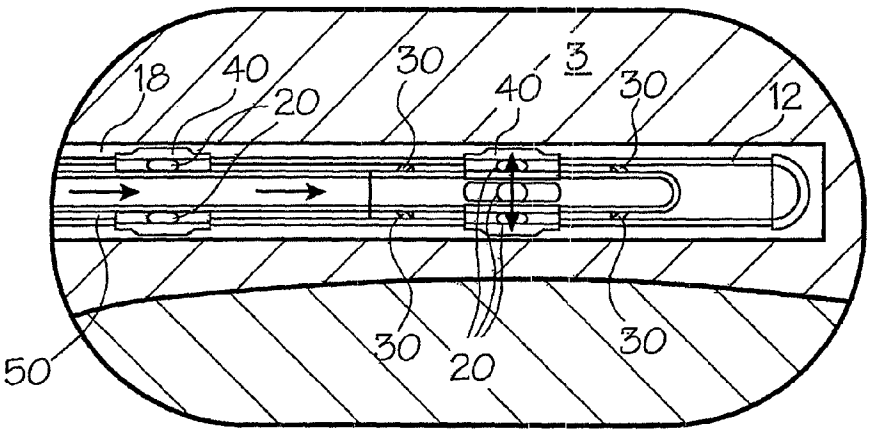
FIG. 1C is a detail of section A of the cross-section of the wellbore and completion string of FIG. 1B with fluid pumped down the treatment tubing.
Figure 13A:
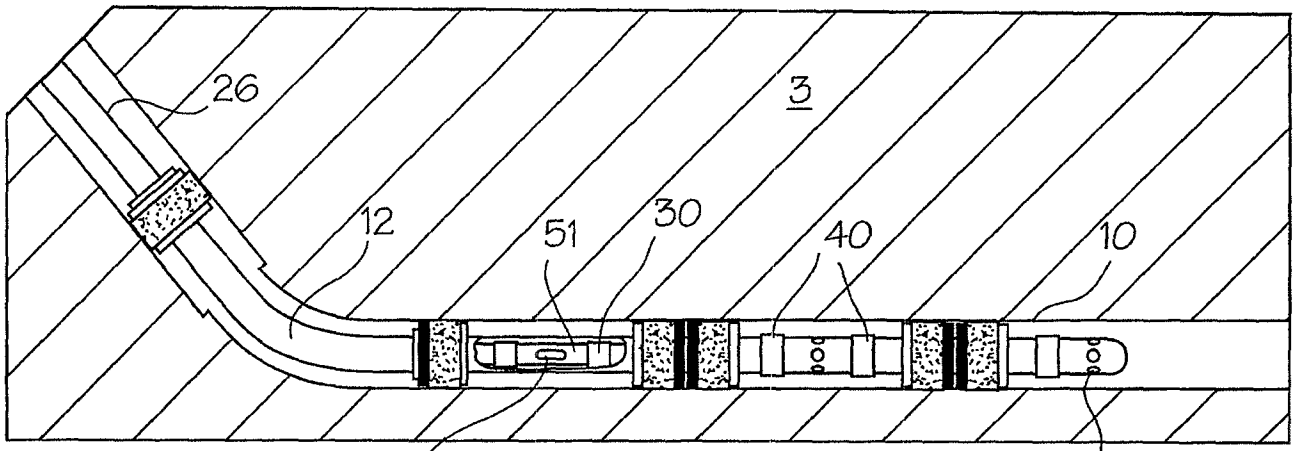
FIG. 13A is a partial cross-section of a wellbore and a completion string in accordance with an embodiment of the invention.
Figure 13B:
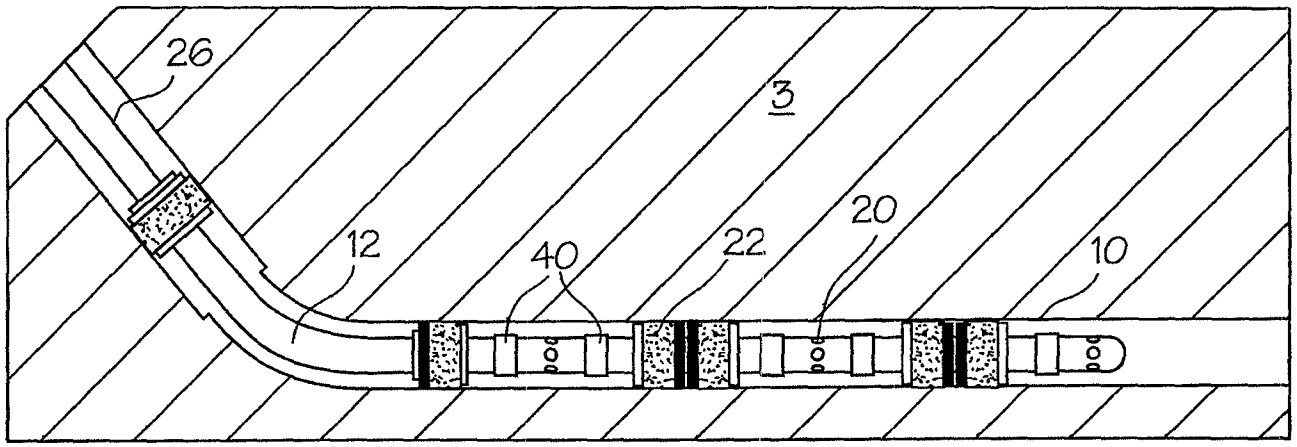
FIG. 13B is a partial cross-section of a wellbore with a completion string and a downhole tool in accordance with an embodiment of the invention.
Figure 14:
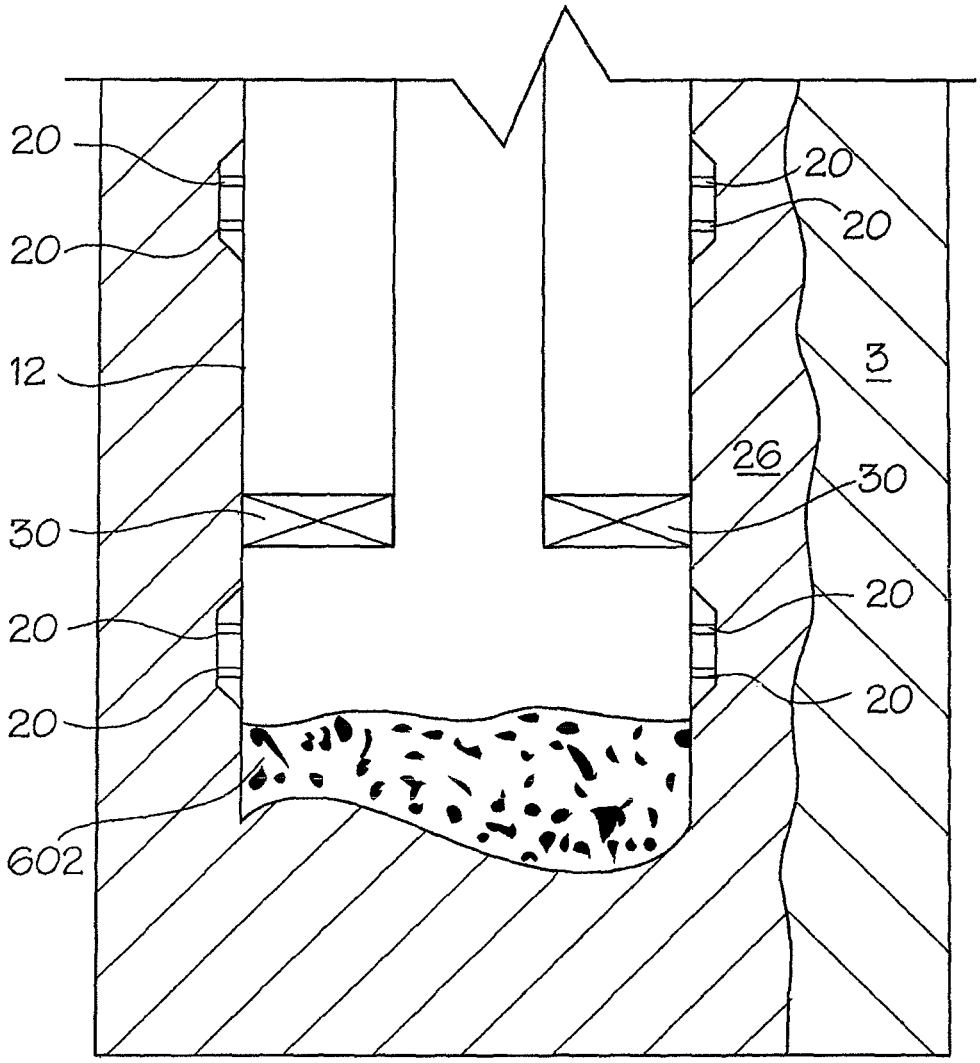
FIG. 14 is a cross section of a wellbore and treatment string with an isolation device.

Referring to FIG. 14, in another embodiment of the invention, the bottom hole assembly is not used. In this embodiment the completion string 12 is inserted in the well bore, and may either be cemented or left open hole. In the case of open hole, exterior annulus isolation elements are required to isolate the interval of interest. In the cemented case, cement 26 secures the completion string 12 to the hydrocarbon bearing subterranean formation 3. The treatment string 50 is inserted into the wellbore and carries a isolation element 30 on its distal end. Particulate matter 602, such as sand, is deposited in the completion string to isolate burst ports by creating what is known as a sand plug 20. The treatment string 50 is then positioned such that the burst port or ports of interest are isolated between the treatment string and its isolation element 30 and the particulate matter (60). Treatment fluid is then pumped down the treatment string 50, ruptures the burst ports 20 and stimulates the interval of interest. Following stimulation, the sand plug can be removed and replaced at a different interval of interest and a further stimulation operation performed. In another embodiment of the present invention, a mechanical bridge plug is used instead of a sand plug. The treatment string 50 is then positioned such that the burst port or ports of interest are isolated between the treatment string and its isolation element 30 and a sealing device (not shown) or the particulate matter Referring to FIGS. 13A and 13B, in another embodiment, a treatment string 50 inserted into the completion string 12 and run down the wellbore. FIG. 1C shows a partial cutout of the completion string 12 to reveal a tool 51 in fluid communication with the treatment string 50. The treatment string 50 may be coiled tubing or jointed pipe. The tool can be any conventional tool for use in these types of operations and that can be attached to a treatment tubing and straddled by at least two isolation devices. These isolation devices may be packers or cups or other sealing means. At least one section of the tool 51, which is a type of cup-cup tool, has an opening 24 out of which fluid can be ejected into the space within the completion string 12. This section of the tool is straddled by isolation devices 30 such that any fluid that ejects from the opening 28 would remain confined in the space between the isolation devices 30.

In each interval, there is an area of the completion string 12 where the wall of the completion string or collar is thinned 20. The thinned areas of the completion string or collar are where the ports 16 will open following rupturing of the burst disks.

Figure 1D:
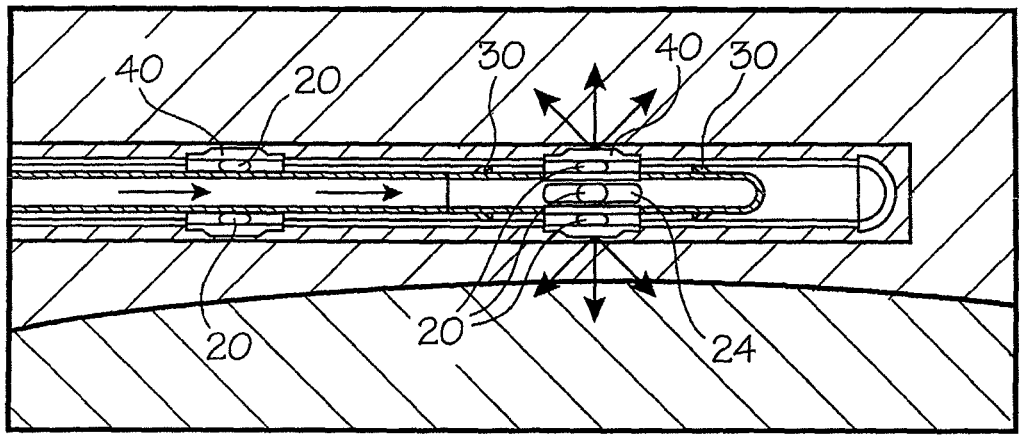
FIG. 1D is a drawing of the cross-section of the wellbore and completion string of FIG. 1C with fluid flowing from the treatment tubing and out the ruptured burst disks.
Figure 1E:
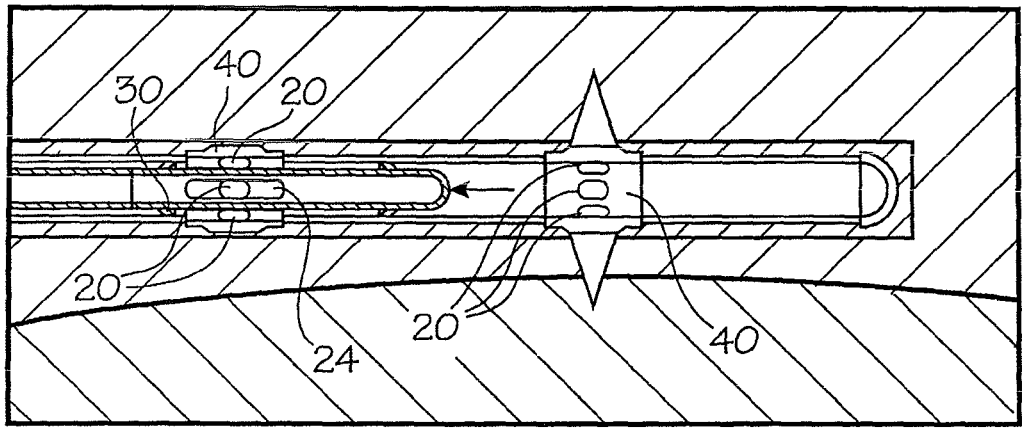
FIG. 1E is a drawing of the cross-section of the wellbore and completion string of FIG. 1A with the tool re-positioned at a second zone.
Figure 1F:
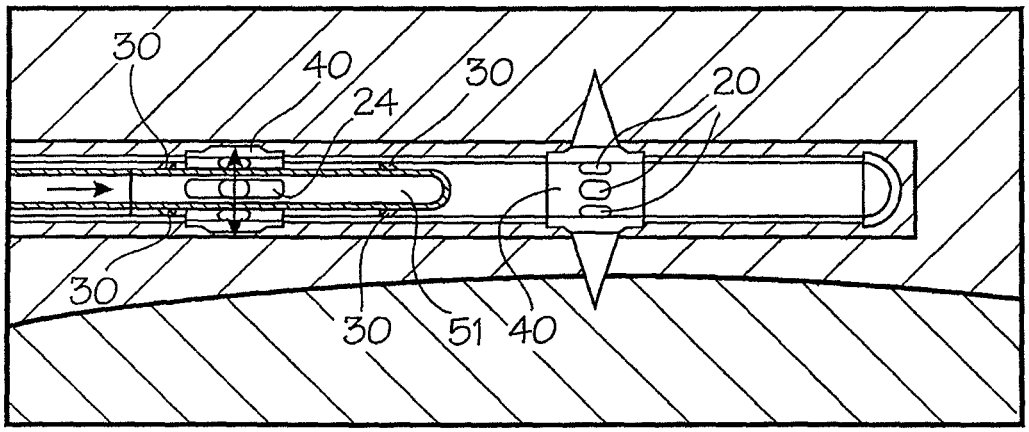
FIG. 1F is a drawing of the cross-section of the wellbore and completion string of FIG. 1E with fluid pumped down the treatment tubing.
Figure 1G:
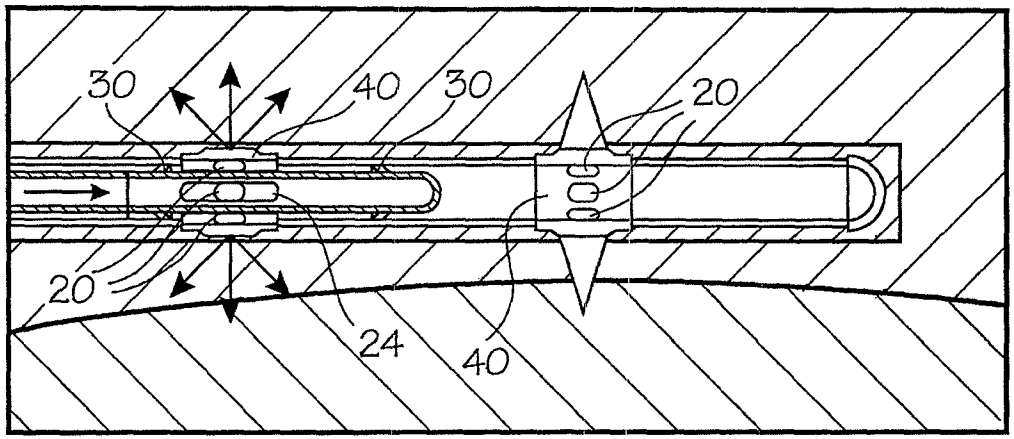
FIG. 1G is a drawing of the cross-section of the wellbore and completion string of FIG. 1E with ruptured burst disks.

The fluid that ejects from the opening 28 of the tool 51 causes an increase in pressure that is sufficient enough to rupture the burst disks, as shown in FIG. 1D, and then stimulate the formation, as shown in FIG. 1E. Following stimulation of the isolated area, the tool may be re-positioned at the next desirable location to be stimulated, as shown in FIG. 1F. The tool may be moved uphole or downhole from the initial ruptured burst disks.

Figure 15:
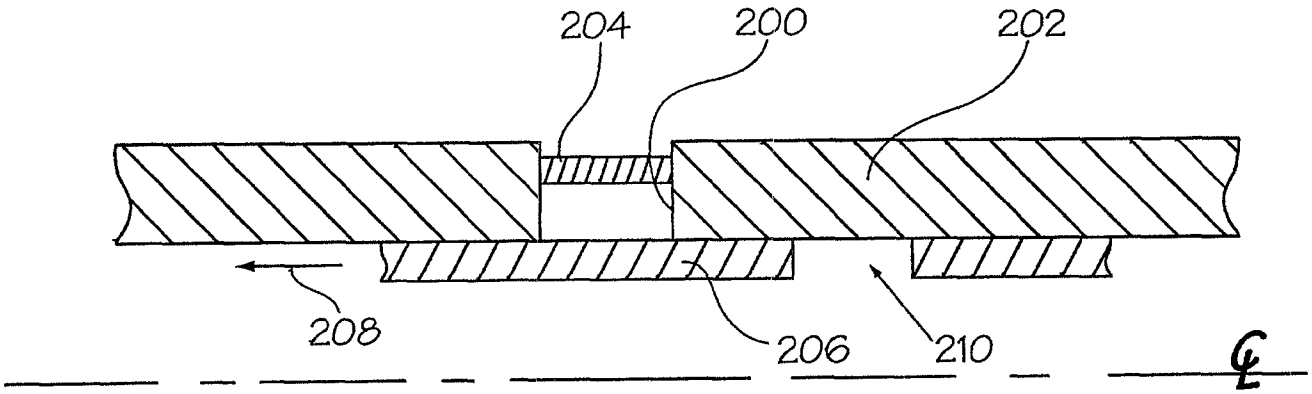
FIG. 15 is a cross-section of a sliding sleeve according to one embodiment of the invention.

Another embodiment of this invention uses the treatment tool combined with the equalization valve in horizontal or vertical wellbores to straddle and isolate intervals containing perforations, holes cut by abrasive jetting, sliding sleeves, or burst disk ports for the purpose of performing treatments. Referring to FIG. 15, a sliding sleeve 206 according to the invention can be adapted to open and close a port 200 in the wall 202 of a tubular member having a burstable disk 204 in the port 200. The sleeve 206 can be slide in the direction 208 whereby the port 200 is opened when the aperture 210 is in at least partial registration with the port 200. The sleeve can be actuated by convention means.

In one embodiment, the method of one embodiment of this invention involves stimulating a formation by pumping treatment fluid under pressure through a treatment tubing and treatment tool. Prior to carrying out this method, the interval of the wellbore to be fractured must be isolated by conventional methods. The spacing between intervals would differ depending on the well, however typically, they may be spaced about every 100 meters. Hydraulic isolation in the exterior annulus can be achieved by having the completion string either cemented into position or by having external packers or other annular sealing device running along the longitudinal length of the completion string. The cement, external packers and annular sealing devices provide hydraulic isolation along the annulus formed by the completion string and the open hole of the wellbore.

A person skilled in the art would understand that treatment fluid needs to be pumped at a sufficient pressure to rupture the burst disks and that this pressure varies depending on the type of burst disk and location of the burst disk. Preferably, the pressure at which fluid is pumped is less than the anticipated break pressure. As discussed above, the initial pumping pressure may in one example be at about 4,200 psi or 31 MPa and at 9000 psi at surface (11,000 psi downhole) in another example.

What is claimed is:

1. A method for stimulating a formation comprising:

providing a tubular member in a wellbore of a subterranean formation, the tubular member having a bore formed therethrough capable of fluid flow and at least one burst disk, each burst disk comprising:

a burstable disk positioned within a wall of the tubular member and in communication with the bore, the burstable disk blocking the flow of fluid therethrough when intact and having a rupture threshold; and a cap sealed within the wall, between the burstable disk and the wellbore, and spaced from the burstable disk for forming a chamber therebetween, the chamber containing a compressible fluid, having a chamber pressure and being pressure isolated from the wellbore, the cap preventing fluid outside the tubular accessing the chamber;

running a treatment tubing having isolation elements thereon and a treatment port therebetween into the bore of the tubular member, forming an annular space between the treatment tubing and the tubular member;

positioning the isolation elements in the annular space above and below at least one burst disk of the at least one burst disks;

pumping fluid through the treatment tubing through the treatment port to the isolated interval for increasing the pressure in the isolated interval until the pressure reaches the rupture threshold;

rupturing the burstable disk of the at least one burst disk in the isolated interval;

moving the treatment tubing and isolation elements downhole from the ruptured burst disks for isolating the tubular bore therebelow; and flowing the treatment fluid through the annular space for exiting the ruptured burst disk for treating the subterranean formation.

2. The method of claim 1, after flowing the treatment fluid, further comprising:

moving the treatment tubing and isolation elements uphole from the ruptured burst disks adjacent another of the at least one burst disks;

positioning the isolation elements in the annular space in the tubular bore above and below the another of the at least one burst disks for isolating another interval about another of the burst disks from the bore of the tubular member;

repeating the steps of pumping, rupturing, moving and flowing for treating the another interval of the subterranean formation.

3. A method for stimulating a formation comprising:

providing a tubular member in a wellbore of a subterranean formation, the tubular member having a bore formed therethrough capable of fluid flow and at least one burst disk, each burst disk comprising:

a burstable disk positioned within a wall of the tubular member and in communication with the bore, the burstable disk blocking the flow of fluid therethrough when intact and having a rupture threshold; and a cap positioned within the wall between the burstable disk and the wellbore, spaced from the burstable disk for forming a chamber therebetween, the chamber containing a compressible fluid, having a chamber pressure being isolated from pressure without, the cap preventing fluid outside the tubular accessing the chamber;

running a treatment tubing comprising isolation elements into the bore of the tubular member, forming an annular space between the treatment tubing and the tubular member;

positioning the isolation elements in the annular space above and below at least one burst disk of the at least one burst disks for isolating an interval about the burst disks from the bore of the tubular member;

pumping fluid through the treatment tubing to the isolated interval for increasing the pressure in the isolated interval until the pressure reaches the rupture threshold;

rupturing the burstable disk of the at least one burst disk in the isolated interval;

displacing the cap toward the wellbore for providing a flow path between the bore and the wellbore;

moving the treatment tubing and isolation elements downhole from the ruptured burst disks for isolating the tubular bore therebelow;

pumping fluid through the annular space between the treatment tubing and the tubular member; and flowing the treatment fluid through the annular space for exiting the ruptured burst disk for treating the subterranean formation.

4. The method of claim 3 further comprising:

moving the treatment tubing and isolation elements uphole from the ruptured burst disks adjacent another of the at least one burstable disks;

positioning the isolation elements in the annular space in the tubular bore above and below the another of the at least one burst disks for isolating another interval about another of the burst disks from the bore of the tubular member; and repeating the steps of pumping, rupturing and flowing for treating the another interval of the subterranean formation.

5. Apparatus for treating at least one interval in a formation along a wellbore comprising:

a completion string deployed along the formation and forming an annulus therebetween, the completion string having a wall therealong and a bore for flowing treatment fluid therethrough;

at least one set of two or more burst disk assemblies located along the wall, the at least one set positioned at the at least one interval, each burst disk assembly comprising:

a port formed through the wall from the bore to the annulus along the completion string;

a burstable disk retained in the port towards an inner surface of the wall adjacent the bore of the completion string; and a cap sealably engaged at an exterior surface of the wall adjacent the annulus and spaced from the burstable disk for defining a chamber therebetween and filled with a compressible fluid, the cap isolating the chamber from the annulus for maintaining the chamber at a substantially constant pressure therein during deployment and when the burstable disk is intact, each burst disk assembly having a pre-determined rupture pressure threshold defined by the substantially constant pressure in the chamber; and the rupture pressure threshold being the same for each burst disk assembly in each of the at least one set of two or more burst disk assembles wherein, when the pressure in the bore adjacent the set of burst disk assemblies reaches a pressure at or above the rupture pressure threshold, each burstable disk of the set of two or more burst disk assembles ruptures for permitting flow of treatment fluid from the bore of the completion string and through each chamber of the ruptured burst disk assemblies, the treatment fluid compressing the compressible fluid in each chamber to release the cap from each burst disk assembly for forming two or more flow paths from the bore through the chambers to the annulus and formation therebeyond.

6. The apparatus of claim 5 wherein segments of the completion string are joined together with one or more collars spaced therealong, the at least one set of the two or more burst disk assemblies being located in one of the one or more collars for positioning at the at least one interval.

7. The apparatus of claim 5 wherein the at least one interval is a plurality of intervals, the apparatus further comprising collars for joining segments of completion string therealong, a set of two or more burst disk assemblies being installed in each collar for positioning at each of the plurality of intervals.

8. The apparatus of claim 7 wherein the rupture pressure threshold of each set of two or more burst disk assemblies in one collar is different from the rupture pressure threshold of another set in another collar of the plurality of collars.

9. The apparatus of claim 8 the rupture pressure threshold increases from a first rupture pressure threshold at a first interval at a toe of the wellbore to at least a second rupture pressure threshold for at least a second interval uphole therefrom.

10. The apparatus of claim 7 wherein the rupture pressure threshold of each set of two or more burst disk assemblies in each of the plurality of collars is the same.

11. The apparatus of claim 7 wherein each collar has a set of two or more burst disk assemblies installed therein and further comprises a plurality of fins extending outwardly towards the formation, the two or more burstable disks assemblies being installed in the outwardly extending fins.

12. The apparatus of claim 5 wherein each chamber is an air pocket at about atmospheric pressure.

13. The apparatus of claim 5 wherein each chamber is maintained at about atmospheric pressure.

14. The apparatus of claim 5 wherein the compressible fluid is air or other fluids.

15. The apparatus of claim 5 wherein each burstable disk is threadably retained within the port.

16. The apparatus of claim 5 wherein each burstable disk is sandwiched in the port between the wall and one or more retainers threadably retained within the port.

17. The apparatus of claim 5 wherein each cap sealably engages the port for preventing pressure outside the completion string from bursting the burstable disk.

18. The apparatus of claim 5 further comprising mastic covering each cap and retaining the cap at the exterior of the port.

19. The apparatus of claim 5 wherein each burstable disk is integral with the wall as a thinned section of wall material in the port at the interior of the wall for sealing the port when intact.

20. The apparatus of claim 5 wherein each burstable disk comprises a thin sheet of material at the interior of the wall for sealing the port when intact.

21. A method for treating one or more intervals in a formation in which a deviated or horizontal wellbore is drilled, the method comprising:

deploying a completion string in a wellbore and forming a wellbore annular space therebetween, the completion string having a wall extending along the wellbore having a bore for flowing treatment fluid therealong, the wall comprising a plurality of segments joined by collars, a set of two or more burst disk assemblies located at each collar positioned at the one or more intervals in the formation, each burst disk assembly having a port formed through the wall of the completion string from the bore to the formation;

a burstable disk retained in the port towards an inner surface of the wall adjacent the bore of the completion string; and a cap sealably engaged at an exterior surface of the wall adjacent the wellbore annular space and spaced from the burstable disk for defining a chamber therebetween, the chamber being filled with a compressible fluid for maintaining a substantially constant pressure therein during deployment and whilst the burstable disk is intact, each burst disk assembly having a pre-determined rupture pressure threshold defined by the substantially constant pressure, the rupture pressure threshold being the same for each burst disk assembly in each of the at least one set;

flowing a treatment fluid through the bore of the completion string for increasing a pressure in the bore to a pressure at or above the rupture pressure threshold for the set of the two or more burstable disks at a first of the one or more intervals for rupturing each of the two or more burstable disks therein;

flowing treatment fluid from the bore into the chamber;

displacing the cap from the exterior of the port with the treatment fluid for forming flow paths through the chamber from the bore to the wellbore annular space; and thereafter continuing to flow treatment fluid through the flow paths from the bore to the wellbore annular space for treating the first interval of the formation.

22. The method of claim 21 wherein each burst disk assembly further comprises mastic covering the exterior of the port, the method further comprising displacing the cap from the exterior of the port into the mastic covering thereover for forming a leak path thereabout for forming the fluid path.

23. The method of claim 21 wherein each set of two or more burstable disks in all of the collars has the same rupture pressure threshold for forming flow paths through the wall at all of the one or more intervals for treating all of the intervals at the same time.

24. The method of claim 21, prior to the flowing the treatment fluid through the bore, the method further comprising isolating the wellbore annular space by flowing and curing cement therein, and wherein the displacing the cap from the exterior of the port further comprises fracturing the cured cement for forming the flow path through the wall.

25. The method of claim 24 wherein at least a next interval of the one or more intervals is to be treated, the method further comprising:

isolating the ruptured burstable disks of the two or more burst disk assemblies at the first interval and thereafter;

flowing a treatment fluid through the bore of the completion string for increasing a pressure in the bore to at or above the rupture pressure threshold for the set of the two or more burstable disks at the next interval for rupturing the burstable disks therein;

flowing treatment fluid from the bore into the chamber;

displacing the cap from the exterior of the port as a result of the fluid entering the chamber for forming a flow path through the wall from the bore to the annular space; and thereafter continuing to flow treatment fluid through the flow path in the wall from the bore to the annular space for treating the next interval of the formation.

26. The method of claim 25 wherein the isolating the ruptured burstable disks of the two or more burst disk assemblies at the first interval comprises setting a sealing device in the completion string between the first interval and the at least a next interval.

27. The method of claim 25 wherein the isolating the ruptured burstable disks of the two or more burst disk assemblies at the first interval comprises pumping frac balls through the completion string for blocking the flow path through the wall of the completion string at the first interval.

28. The method of claim 25 wherein the isolating the ruptured burstable disks of the two or more burst disk assemblies at the first interval comprises pumping particulate matter through the completion string for blocking the flow path through the wall of the completion string at the first interval.

29. The method of claim 21, wherein the completion string is in an open hole, prior to flowing treatment fluid through the bore, the method further comprising isolating the annular space between the completion string and the formation at least below the set of two or more burstable disks at an interval of the one or more intervals of the formation to be treated.

30. The method of claim 21, wherein the wellbore annular space is isolated with cured cement positioned in the annulus between the completion string and the formation, prior to flowing treatment fluid through the bore, the method further comprising:

running a treatment tool into the bore of the completion string using a treatment string, the treatment tool comprising at least one treatment port for delivering treatment fluid from a bore of the treatment string to outside the treatment tool; and isolation devices for isolating a treatment annulus formed between the treatment tool and the completion string above and below the set of two or more burst disk assemblies at each interval;

positioning the treatment tool, using the treatment string, adjacent the set of two or more burst disk assemblies at one of the one or more intervals in the formation;

actuating the isolation devices for isolating the treatment annulus above and below the set of two or more burst disk assemblies; and flowing the treatment fluid through the bore of the treatment string to the treatment tool, the fluid exiting the at least one treatment port for increasing a pressure in the treatment annulus between the isolation apparatus at or above the rupture pressure threshold for rupturing the burstable disk in each of the two or more burst disk assemblies; and flowing treatment fluid through the flow paths through the wall of the completion string.

31. The method of claim 30, when a next interval is to be treated, further comprising:

releasing pressure to permit moving the isolation devices;

moving the treatment string to position the treatment tool at the next interval of the one or more intervals; and repeating the steps of isolating, flowing to increase pressure at least to the threshold pressure of the burstable disks and flowing treatment fluid through the flow paths.

32. The method of claim 21 wherein the wellbore is open hole, the method further comprising:

isolating the wellbore annular space with exterior annulus isolation elements above and below the first interval of the one or more intervals;

running a treatment tool into the bore of the completion string using a treatment string, the treatment tool comprising at least one treatment port for delivering treatment fluid from a bore of the treatment string to outside the treatment tool; and isolation devices for isolating a treatment annulus formed between the treatment tool and the completion string above and below the two or more burstable disks at each interval;

positioning the treatment tool, using the treatment string, adjacent the set of two or more burst disk assemblies at one of the one or more intervals in the formation;

actuating the isolation devices for isolating the treatment annulus above and below the set of two or more burst disk assemblies; and flowing the treatment fluid through the bore of the treatment string to the treatment tool, the fluid exiting the at least one treatment port for increasing a pressure in the treatment annulus between the isolation apparatus at or above the rupture pressure threshold for rupturing the burstable disk in each of the two or more burst disk assemblies; and flowing treatment fluid through the flow paths through the wall of the completion string.

33. The method of claim 32 further comprising:

releasing pressure to permit movement of the isolation devices;

moving the treatment string to position the treatment tool at another of the one or more intervals; and repeating the steps of isolating, flowing to increase pressure at least to the threshold pressure of the burstable disks and flowing treatment fluid through the flow paths.

34. The method of claim 32 wherein the isolation devices comprise an isolation element at the distal end of the treatment string, the method further comprising:

positioning the distal isolation element downhole of the set of burst disk assemblies at the first interval to isolate therebelow;

flowing the treatment fluid through the bore of the treatment string to the treatment tool, the fluid exiting the at least one treatment port for increasing a pressure in the treatment annulus above the distal isolation apparatus at or above the rupture pressure threshold for rupturing the burstable disk in each of the two or more burst disk assemblies;

moving the treatment string to position the treatment tool at a next interval of the one or more intervals; and positioning a plug in the completion string at the set of ruptured burst disk assemblies at the first interval for isolating the burst disk assemblies.

35. The method of claim 34 when at least the next interval is to be treated, further comprising repeating the step of flowing treatment fluid, moving the treatment string and positioning a plug for the at least the next interval.

36. A method for treating zones of interest in a formation in which a deviated or horizontal wellbore is drilled, the method comprising:

deploying a completion string in a wellbore, the completion string having a wall therealong and a bore for flowing treatment fluid therealong, the completion string having at least one set of two or more burst disk assemblies located in the wall at a toe thereof, each burst disk assembly comprising:

a port formed through the wall of the completion string from the bore to the wellbore downhole therefrom;

a burstable disk retained in the port towards an inner surface of the wall adjacent the bore of the completion string; and a cap sealably engaged at an exterior surface of the wall adjacent the toe of the wellbore and spaced from the burstable disk for defining a chamber therebetween, the chamber being filled with a compressible fluid and fluidly blocked from the wellbore for maintaining a substantially constant pressure therein during deployment and when the burstable disk is intact, each burst disk assembly having a rupture pressure threshold resulting from the substantially constant pressure, the rupture pressure threshold being the same for each burst disk assembly in the set; and flowing a treatment fluid through the bore of the completion string to increase pressure at least to the rupture pressure threshold of the burstable disks such that each burstable disk of the set ruptures;

flowing treatment fluid from the bore of the completion string into the chamber, the fluid acting to displace the cap from the port and forming a flow path from the bore through the chamber to the wellbore therebeyond.

37. A method for treating zones of interest in a formation in which a deviated or horizontal wellbore is drilled, the method comprising:

deploying a completion string in a wellbore and forming an annulus therebetween, the completion string having a wall therealong and a bore for flowing fluid therealong; the completion string having at least one set of two or more burst disk assemblies located along the wall, the at least one set positioned at the at least one interval, each burst disk assembly comprising:

a port formed through the wall of the completion string from the bore to the annulus;

a burstable disk retained in the port towards an inner surface of the wall adjacent the bore of the completion string; and a cap sealably engaged at an exterior surface of the wall adjacent the annulus and spaced from the burstable disk for defining a chamber therebetween, the chamber being filled with a compressible fluid and fluidly blocked from the annulus for maintaining a substantially constant pressure therein during deployment and when the burstable disk is intact, wherein each burst disk assembly has a rupture pressure threshold resulting from the substantially constant pressure, the rupture pressure threshold being the same for each burst disk assembly in each of the at least one set, such that when a fluid pressure of a first fluid in the bore adjacent the set of burst disk assemblies reaches the rupture pressure threshold, each burstable disk of the set ruptures for permitting flow of the first fluid from the bore of the completion string into chamber, the first fluid acting to release the cap from the port and forming a flow path from the bore through the chamber to the annulus and formation therebeyond;

running a treatment tool into the bore of the completion string using a treatment tubing string to a first, lowest interval of interest, the treatment tool comprising at least one port for delivering the first fluid from a bore of the treatment string to outside the treatment tool; and isolation devices for isolating a treatment annulus between the treatment tool and the completion string uphole and downhole of the two or more burstable disks at each interval;

positioning the treatment tool adjacent the two or more burstable disks in the first lowest interval;

actuating the isolation apparatus for isolating the treatment annulus uphole and downhole of the two or more burstable disks;

delivering the first fluid through the bore of the treatment string to the treatment tool, the first fluid exiting the at least one port for increasing a pressure in the treatment annulus between the isolation apparatus at or above the rupture pressure threshold for rupturing the burstable disk in each of the two or more burstable disks;

flowing the first fluid from the bore of the treatment string into the chambers;

displacing the caps from the exterior of the ports for forming the flow paths;

moving the treatment tool to below the ruptured at least two burstable disks;

actuating the isolation apparatus for isolating the treatment annulus below the ruptured burstable disks; and flowing a second fluid through the treatment annulus to flow through the flow paths in the wall for treating the formation therebeyond.

38. The method of claim 37 wherein the first lowest interval is adjacent a toe of the wellbore.

39. A method for treating zones of interest in a formation in which a deviated or horizontal wellbore is drilled, the method comprising:

installing a completion string in a wellbore and forming an annulus therebetween, the completion string having a wall therealong and a bore for flowing fluid therealong, the completion string having at least one set of two or more burst disk assemblies located along the wall, the at least one set positioned at the at least one interval, each burst disk assembly comprising:

a port formed through the wall of the completion string from the bore to the annulus;

a burstable disk retained in the port towards an inner surface of the wall adjacent the bore of the completion string; and a cap sealably engaged at an exterior surface of the wall adjacent the annulus and spaced from the burstable disk for defining a chamber therebetween, the chamber being filled with a compressible fluid and fluidly blocked from the annulus for maintaining a substantially constant pressure therein during deployment and when the burstable disk is intact, wherein each burst disk assembly having a rupture pressure threshold resulting from the substantially constant pressure in the chamber, the rupture pressure threshold being the same for each burst disk assembly in each of the at least one set, such that when fluid pressure of a first fluid in the bore adjacent the set of burst disk assemblies reaches the rupture pressure threshold, each burstable disk of the set ruptures for permitting flow of the first fluid from the bore of the completion string into chamber, the first fluid acting to release the cap from the port and forming a flow path from the bore through the chamber to the annulus and formation therebeyond;

running a treatment tool into the bore of the completion string using a treatment tubing string to the first set of burst disk assemblies in the wellbore, the treatment tool comprising:

at least one port for delivering a fluid from a bore of the treatment string to outside the treatment tool; and isolation devices for isolating a treatment annulus between the treatment tool and the completion string uphole and downhole of the two or more burstable disks at each interval;

positioning the treatment tool adjacent the two or more burstable disks in the first interval;

actuating the isolation apparatus for isolating the treatment annulus uphole and downhole of the two or more burstable disks;

delivering the first fluid through the bore of the treatment string to the treatment tool, the first fluid exiting the at least one port for increasing a pressure in the treatment annulus between the isolation apparatus at or above the rupture pressure threshold for rupturing the burstable disk in each of the two or more burstable disks;

flowing the first fluid from the bore of the treatment string into the chambers;

displacing the cap from the exterior of the port for forming the flow paths; and flowing a second fluid through the treatment tool to flow through the flow paths in the wall for treating the formation therebeyond.

40. The method of claim 39, prior to running the treatment tool, further comprising:

cementing the annulus between the completion string and the formation for isolation of zones in the formation; and curing the cement.

41. The method of claim 39 wherein the completion is open hole and at least prior to flowing the second fluid through the treatment tool to flow through the flow paths to treat the formation, the method further comprising:

setting isolation elements in the annulus between the completion string and the formation for isolation of zones in the formation.

* * * * *